US007637827B2

(12) United States Patent
Bangerter

(10) Patent No.: US 7,637,827 B2
(45) Date of Patent: Dec. 29, 2009

(54) TABLE TENNIS GAME HAVING A PLAYING SURFACE DIVIDED INTO MULTIPLE INDEPENDENT PLAYING STATIONS BY INTERSECTING RIGID BARRIERS

(76) Inventor: Vern William Bangerter, 412 S. 100 East, Salem, UT (US) 84653

( * ) Notice: Subject to any disclaimer, the term of this patent is extended or adjusted under 35 U.S.C. 154(b) by 375 days.

(21) Appl. No.: 11/621,388

(22) Filed: Jan. 9, 2007

(65) Prior Publication Data

US 2007/0191132 A1 Aug. 16, 2007

Related U.S. Application Data

(60) Provisional application No. 60/772,813, filed on Feb. 13, 2006.

(51) Int. Cl.
*A63B 67/04* (2006.01)

(52) U.S. Cl. ..... 473/496

(58) Field of Classification Search ..... 473/496, 473/475; 108/59, 60, 115, 153.1, 158.12, 108/162

See application file for complete search history.

(56) References Cited

U.S. PATENT DOCUMENTS 2,497,925 A * 2/1950 Bergerioux ..... 273/331
3,452,985 A 7/1969 D'Zmura
4,108,434 A 8/1978 Royer
D254,018 S * 1/1980 Malm et al. ..... D21/301
4,335,877 A * 6/1982 Long ..... 473/475
4,522,395 A 6/1985 Arndt
D329,063 S * 9/1992 Kantor ..... D21/355
7,367,907 B1 * 5/2008 Sutton et al. ..... 473/496
2004/0005941 A1 * 1/2004 Chen ..... 473/496

* cited by examiner

*Primary Examiner*—Raleigh W. Chiu
(74) *Attorney, Agent, or Firm*—Angus C. Fox, III

(57) ABSTRACT

A game table for playing variations of table tennis using at least one ball includes a table top having a playing surface and a plurality of generally identical, intersecting, equiangularly-spaced, rigid barriers positioned atop the playing surface and radiating from a center point thereof, the rigid barriers dividing the playing surface into at least three and no more than four independent playing stations, all of which are of identical size and shape. The table top of one embodiment is made of four interfolding pieces which are supported by four folding leg assemblies and a storage/transport dolly. That of another is made of three or four separate pieces, which are shaped to fit together, in regions beneath the barriers, like pieces of a jigsaw puzzle. That of another is divided into hingeably intercoupled halves which can be folded together for storage, with each half corresponding to two playing stations.

20 Claims, 26 Drawing Sheets

FIG. 4
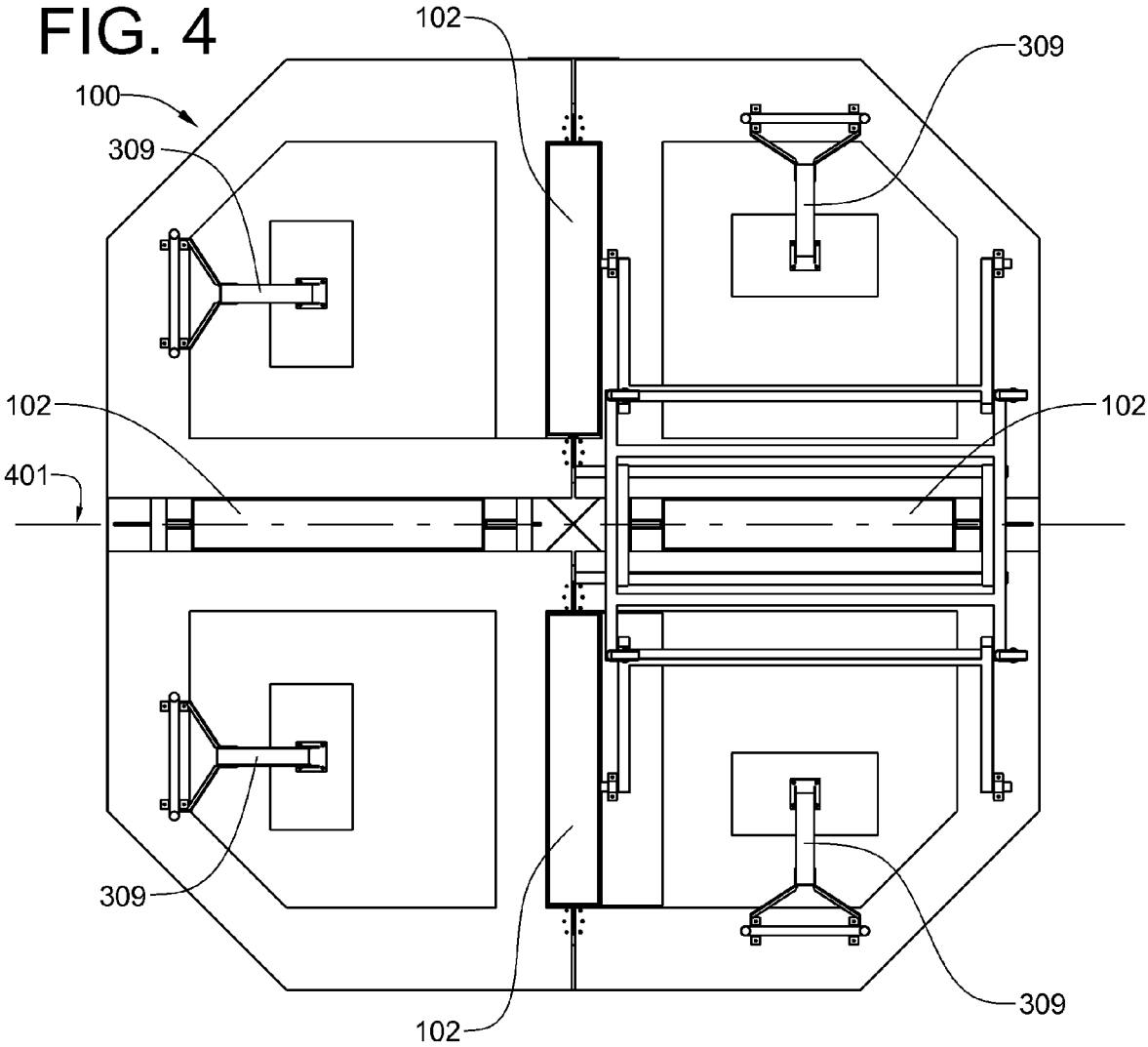
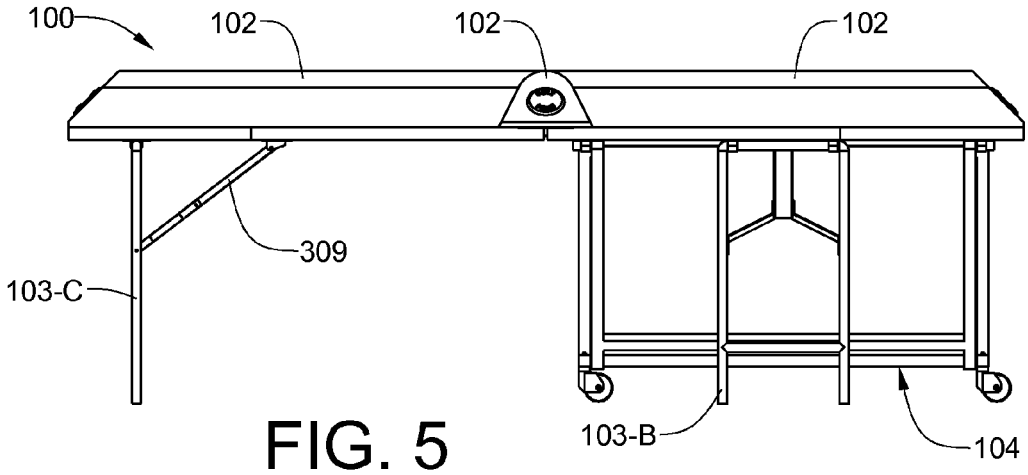
FIG. 5

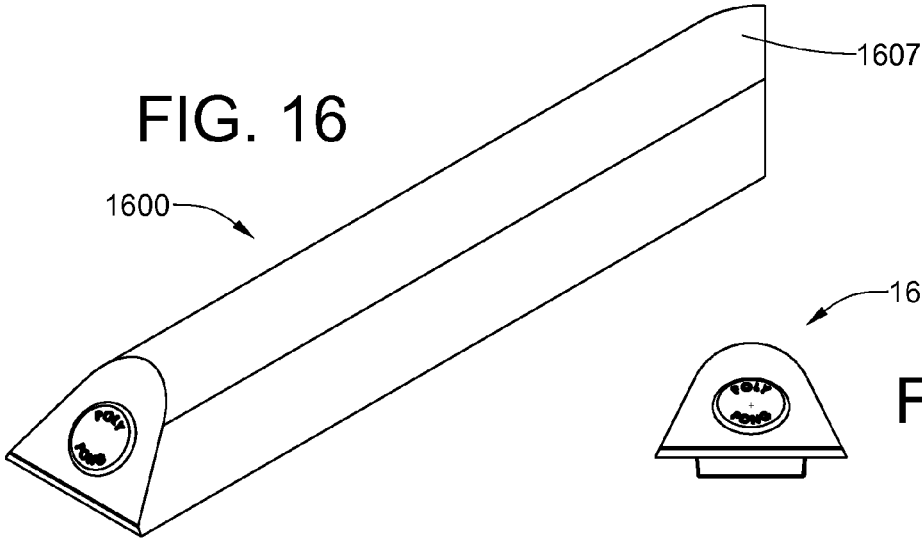
FIG. 16
FIG. 17
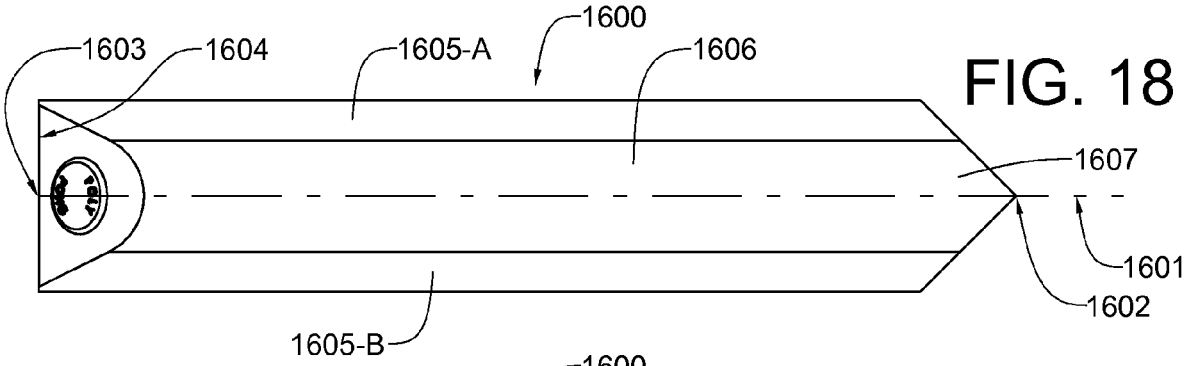
FIG. 18
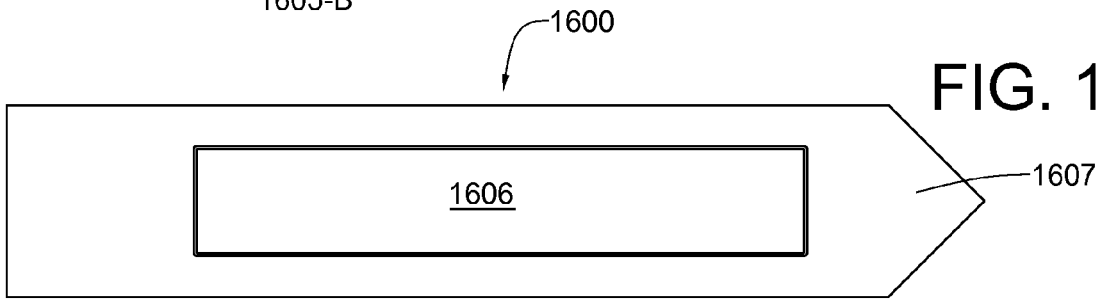
FIG. 19
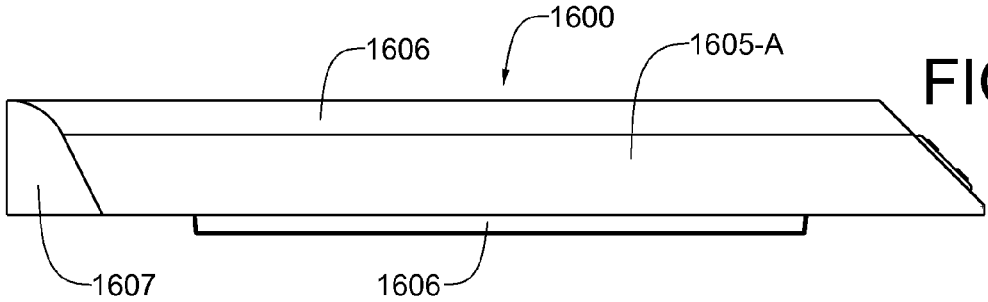
FIG. 20

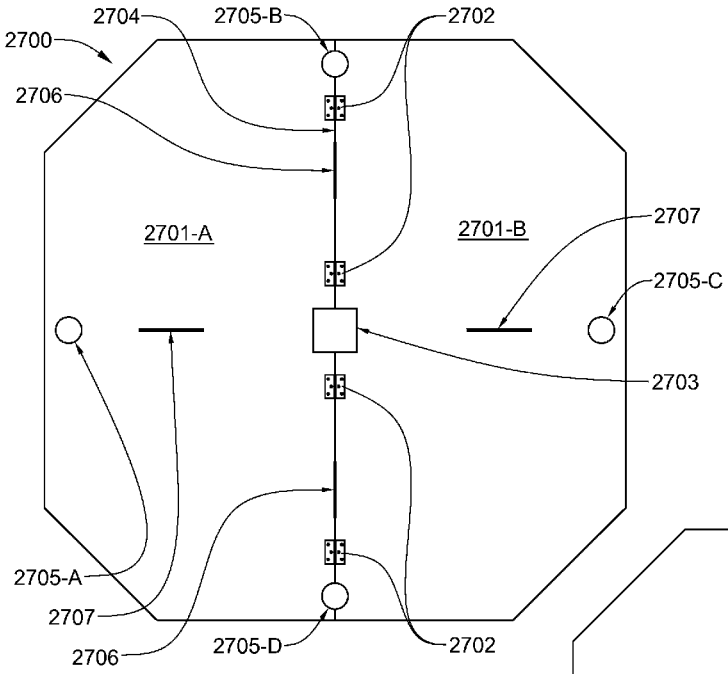
FIG. 27
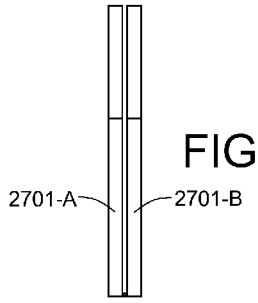
FIG. 28
FIG. 29
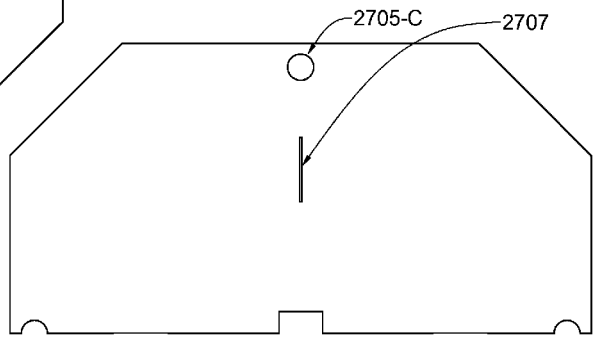

TABLE TENNIS GAME HAVING A PLAYING SURFACE DIVIDED INTO MULTIPLE INDEPENDENT PLAYING STATIONS BY INTERSECTING RIGID BARRIERS

This application has a priority date based on the filing of Provisional Patent Application No. 60/772,813, titled PING-PONG GAME ALLOWING THREE OR FOUR INDEPENDENT PLAYERS, on Feb. 13, 2006.

FIELD OF THE INVENTION

This invention relates generally to apparatus for games in which a projectile, such as a ball or shuttlecock, is hit back and forth over a net or other barrier. More specifically, the invention relates table apparatus having three or four independent playing stations which are used for table tennis or "ping-pong" game variants.

BACKGROUND OF THE INVENTION

Table tennis, or ping-pong as it is often called, utilizes, in its most common form, a table having two independent playing stations divided by a vertically-oriented net of generally uniform height. The game is thus limited to two players or two teams of typically two players each. At social functions with many attendees where table tennis is being played, the queue for an opportunity to play can seem interminably long. The prior art has addressed this problem in a number of ways. U.S. Pat. No. 3,452,985 to Cornelius J. D'Zmura discloses a game table having a circular playing surface which is divided by intersecting nets into three or four playing stations. The game is played with rules similar to those of table tennis, except that points are accumulated on a negative basis. Any player who accumulates a set number of negative points drops out of play and is replaced by a new player. U.S. Pat. No. 4,108,434 to George R. Royer and U.S. Pat. No. 4,522,395 to Guenter Arndt both disclose game tables that are variations on the theme of '985 patent to D'Zmura. Royer discloses a table tennis game for four players having an upper playing surface divided into four quadrants by four nets, each of which extend radially from an open cylindrical member centered in the table. The Arndt table, on the other hand, discloses a table tennis game having a table with multiple nets attached to a rotatable central hub. A conical member extends from net height above the hub, and a sphere is attached on a stalk above the conical member. The conical member and sphere are playing surfaces which add additional excitement to the game.

One of the problems associated with large, three-and-four-station tables is that they do not lend themselves to compact storage. Another problem associated with net-based games is that the nets frequently become misadjusted or slack.

What is needed is a game table for a table tennis type game, which not only provides up to four separate playing stations, but which also eliminates the use of nets and solves the storage problem heretofore described.

SUMMARY OF THE INVENTION

The present invention provides a new style of game table for a table tennis type game. The table is divided into three or four independent playing stations by rigid semicylindrical barriers which intersect in the center of the table. Several embodiments of the table are disclosed.

One embodiment of the game table has a playing surface that is divided into four individual quarter-section pieces, each of which corresponds to an individual playing station. The table is divided along a line of bilateral symmetry into first and second pairs of adjacent quarter-section pieces. The pairs are not directly intercoupled. However, the quarter-section pieces of each pair are hingeably intercoupled, such than an outer quarter-section piece folds on top of an inner quarter-section piece. A dolly used for support and transport of the table when folded, is positioned beneath both inner quarter-section pieces and centered between them. Each inner quarter-section piece is also equipped with a folding support which, when extended, supports the associated quarter-section piece when the table is unfolded to an open playing configuration. The dolly also provides additional support, particularly for the inner quarter-section pieces when the table is unfolded opened. In addition, the dolly also has a pair of elevated horizontal rails, each of which engages a slot on an inner quarter-section piece, thereby aligning the first and second quarter-section pairs so that they are immediately adjacent one another when the table is unfolded. A first support member is hingeably coupled to both a bottom portion of a first side of the dolly and to a bottom surface of the inner quarter-section piece of the first quarter-section pair and a second support member is hingeably coupled to both a bottom portion of a second side of the dolly and to a bottom surface of the inner quarter-section piece of the second quarter-section pair. After each outer quarter-section piece is folded onto the inner quarter-section piece to which it is hingeably coupled, both quarter-section pairs can be rotated to a generally vertical positions so that the table can be stored on opposite sides of the dolly.

Another embodiment is of reduced size for young players, has four playing stations, and can be either placed on the floor or strapped to the square top of a card table. The playing surface is divided into four identical quarter sections, which fit together in regions covered by the rigid barriers like pieces of a jigsaw puzzle. A three playing station version has a playing surface that is divided into three identical third sections, which also fit together in regions covered by the rigid barriers like pieces of a jigsaw puzzle.

Still another embodiment has four playing stations and is divided into halves which are hingeably intercoupled so that the two halves can be folded together for storage or transport. Each half corresponding to two adjacent playing stations.

BRIEF DESCRIPTION OF THE DRAWINGS

FIG. 4 is a bottom plan view of the first embodiment new game table;

FIG. 5 is an isometric, almost side elevational view of the first embodiment new game table;

FIG. 16 is an isometric view of a single barrier of the first embodiment new game table;

FIG. 17 is an outer end elevational view of the barrier of FIG. 16;

FIG. 18 is a top plan view of the barrier of FIG. 17;

FIG. 19 is a bottom plan view of the barrier of FIG. 17;

FIG. 20 is a side elevational view of the barrier of FIG. 17;

FIG. 27 is a top plan view of the table top of a third embodiment new game table;

FIG. 28 is an elevational end view of the table top of FIG. 27, folded at the center line;

FIG. 29 is an elevational side view of the table top of FIG. 27, folded at the center line;

PREFERRED EMBODIMENT OF THE INVENTION

The various embodiments of the invention will now be described in detail with reference to the attached drawing figures. It is to be understood that the drawings are not necessarily drawn to scale and that they are intended to be merely illustrative.

Figure 1:
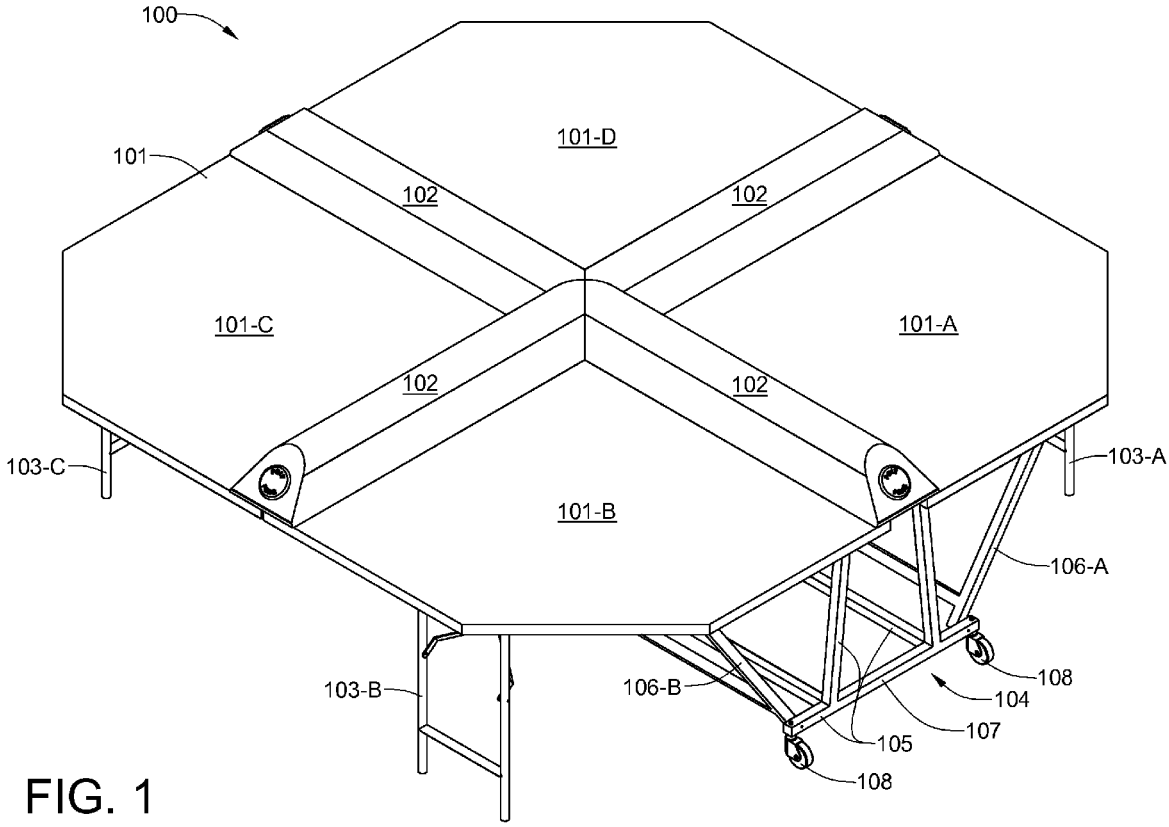
FIG. 1 is an isometric view of a first embodiment new game table, taken from the dolly end thereof.

Referring now to FIG. 1, a first embodiment new game table 100 has an octagonal table top 101 comprised of four separate quarter-section pieces: inner quarter-section pieces 101-A and 101-B; and outer quarter-section pieces 101-C and 101-D. Four identical rigid barriers 102, are positioned on the tabletop 101 in a cross formation. The outer edge of each quarter-section piece 101-A, 101-B, 101-C and 101-D is supported by a folding leg assembly 103-A, 103-B, 103-C and 103-D (not shown in this view), respectively. The abutting edges of the inner quarter-section pieces 101-A and 101-B are further supported by a dolly 104 that is made from square cross-section tubing 105, provided with first and second support members 106-A and 106-B, which are rotatably coupled to opposite sides of the base or lower portion 107 of the dolly 104. Each inner quarter-section piece 101-A and 101-B is attached to the dolly only via its associated support member 106-A and 106B, respectively. In addition, the dolly is equipped with four swiveling casters 108, only two of which are seen in this view.

Figure 2:
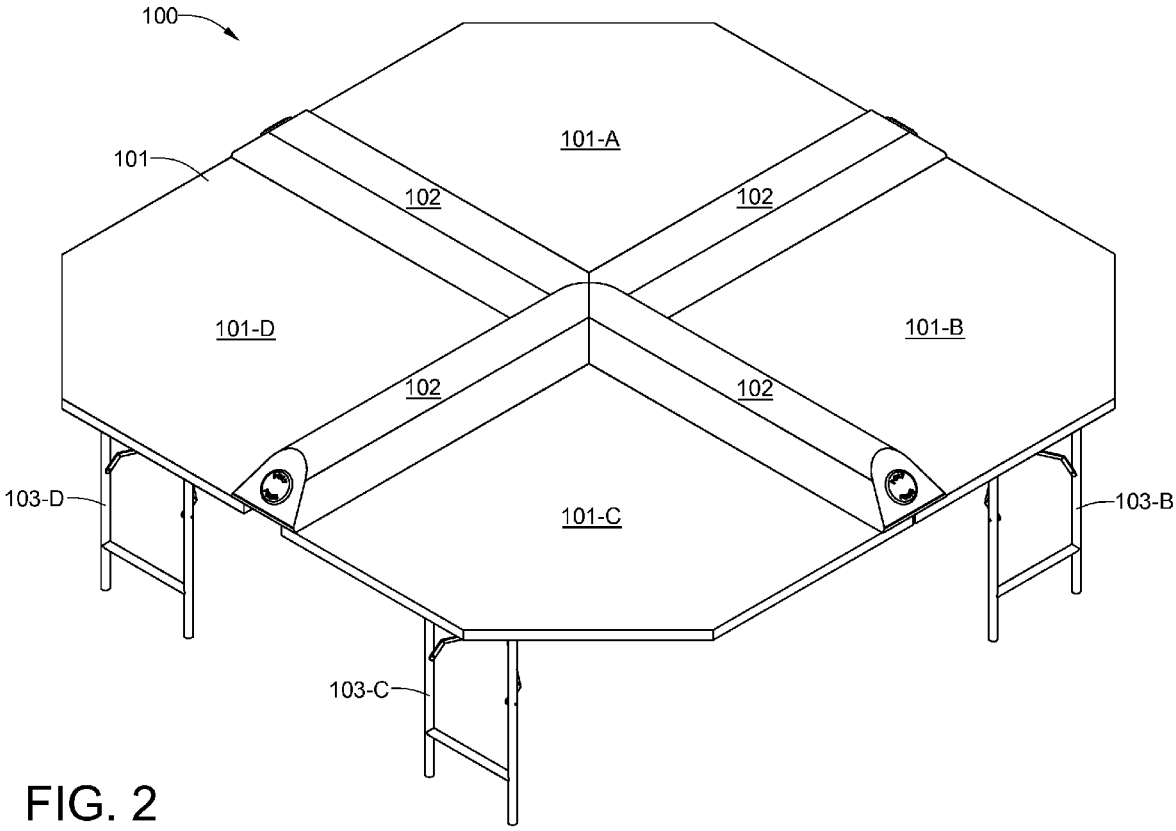
FIG. 2 is an isometric view of the first embodiment new game table, taken opposite the end where the dolly is installed.

Referring now to FIG. 2, in this view of the opposite end of the first embodiment game table 100, folding leg assemblies 103-B, 103-C and 103-D can be seen.

Figure 3:
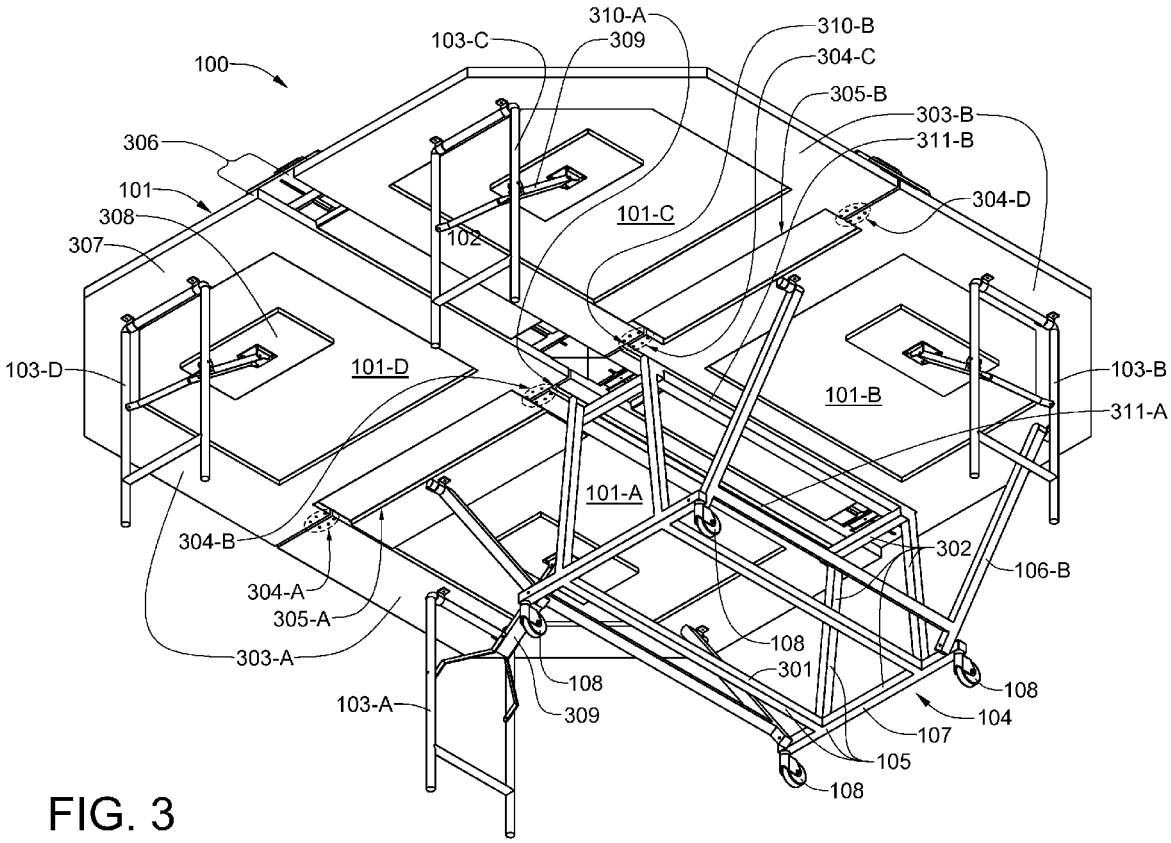
FIG. 3 is an isometric view of the first embodiment new game table, showing primarily the underside thereof.

Referring now to FIG. 3, this view of the underside of the first embodiment game table 100 shows all four folding leg assemblies 103-A, 103-B, 103-C and 104-D. In addition, the dolly 104 is completely visible in this view. It will be noted that the dolly 104 has a box frame 301 made from the square cross-section tubing 105. The tubing at each end of the box frame forms an equilateral trapezoid 302 which is inherently rigid. In this view, it can be seen that the dolly 104 is, in fact, equipped with four swiveling casters 108, which facilitate transport of the game table 101. In this view, it can also be seen that support member 106-A is rotatably attached to both inner quarter-section piece 101-A and to the far side of the base portion 107 of the dolly 104. Likewise, support member 106-B is rotatably attached to both inner quarter-section piece 101-B and to the near side of the base portion 107 of the dolly 104. Quarter-section pieces 101-A and 101-D form a first quarter-section piece pair 303-A, while quarter-section pieces 101-B and 101-C form a second quarter-section piece pair 303-B. It will be noted that the quarter-section pieces of each quarter-section piece pair are hingeably coupled together. First and second screw patterns 304-A and 304-B correspond to the position of the hinges on the upper surface of the table top 101 that hingeably intercouple the pieces of the first quarter-section piece pair 303-A, while third and fourth screw patterns 304-C and 304-D correspond to the position of the hinges on the upper surface of the table top 101 that hingeably intercouple the pieces of the second quarter-section piece pair 303-B. It will be noted that when the game table 100 is set up in a playing configuration, the four quarter-section pieces 101-A, 101-B, 101-C and 101-D form two barrier locating apertures 305-A and 305-B between the pieces of the first and second quarter-section piece pairs 303-A and 303-B, respectively, which both laterally and longitudinally locate the barriers between the quarter-section pieces of each quarter-section piece pair on the table top 101. A single gap 306 is formed between the quarter-section piece pairs 303-A and 303-B, which laterally locate the remaining two barriers. Longitudinal location of the barriers is not really required, but can be achieved using at least one locator pin installed along the inner edge of one of each inner and outer opposed quarter-section pieces. The downward projection (see FIGS. 19 and 20) on the two barriers used between the two quarter-section piece pairs 303-A and 303-B can be notched to fit over the locator pins. It will also be noted that each quarter-section piece 101-A, 101-B, 101-C and 101-D is double thickness around its edges 307 and in the center region 308 where the folding strut 309 for the associated folding leg assembly 103-A, 103-B, 103-C or 103-D is anchored. It will be further noted that each inner quarter-section piece 101-A and 101-B is equipped with a groove 310-A and 310-B, respectively, which fit over opposed horizontal upper tubes 311-A and 311-B, respectively, which act as locator rails to properly position the two quarter-section piece pairs 303-A and 303-B with respect to one another.

Referring now to FIG. 4, it will be noted that the game table 101 is bilaterally symmetrical about a line 401 passing midway between the two quarter-section piece pairs 303-A and 303-B. Although as currently being manufactured, the first embodiment game table 100 has a table top that just fits within a square having sides that measure 102 inches or 2.59 meters, the table may be sized differently. Clearly, a larger table top lends itself to faster play, as the ball is less likely to miss the table during a fast shot or slam.

Referring now to FIG. 5, this elevational view gives an idea of the relative height of the rigid barriers 102.

Figure 6:
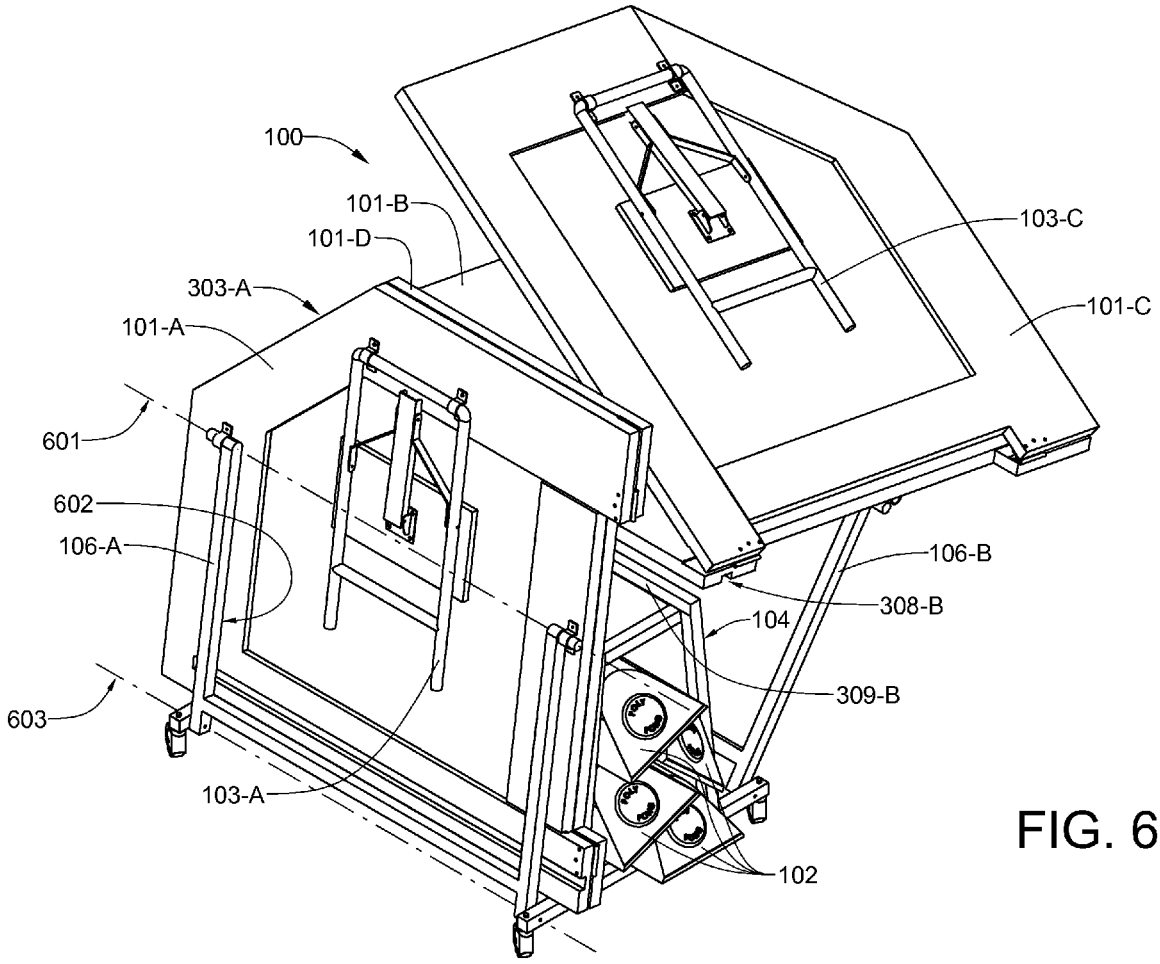
FIG. 6 is an isometric view of the first embodiment new game table in a semi-stowed state.

Referring now to FIG. 6, the first embodiment new game table 100 has been partially configured for storage or transport by removing the rigid barriers 102 from the table top 101 and placing them within the framework of the dolly 104. In addition, each of the four folding leg assemblies 103-A, 103-B, 103-C and 104-D has been folded against the underside of its respective quarter-section piece 101-A, 101-B, 101-C or 101D, and the outer quarter-section piece 101-D of the first quarter-section piece pair 303-A has been folded on top of its associated inner quarter-section piece 101-A, the folded first quarter-section piece pair 303-A has been rotated about the upper pivot axis 601 of the first support member 106-A so that it is touching the dolly-facing side 602 of the first support member 106-A, and the first support member 106-A has been rotated about its lower pivot axis 603 so that the folded first quarter-section piece pair 303-A is leaning against the framework of the dolly 104 for storage or transport. The outer quarter-section piece 101-C of the second quarter-section piece pair 303-B is being folded over the inner quarter-section piece 101-B, and the groove 310-B in the inner-quarter-section piece 101-B has been lifted off the horizontal upper tube 311-B of the dolly 104.

Figure 7:
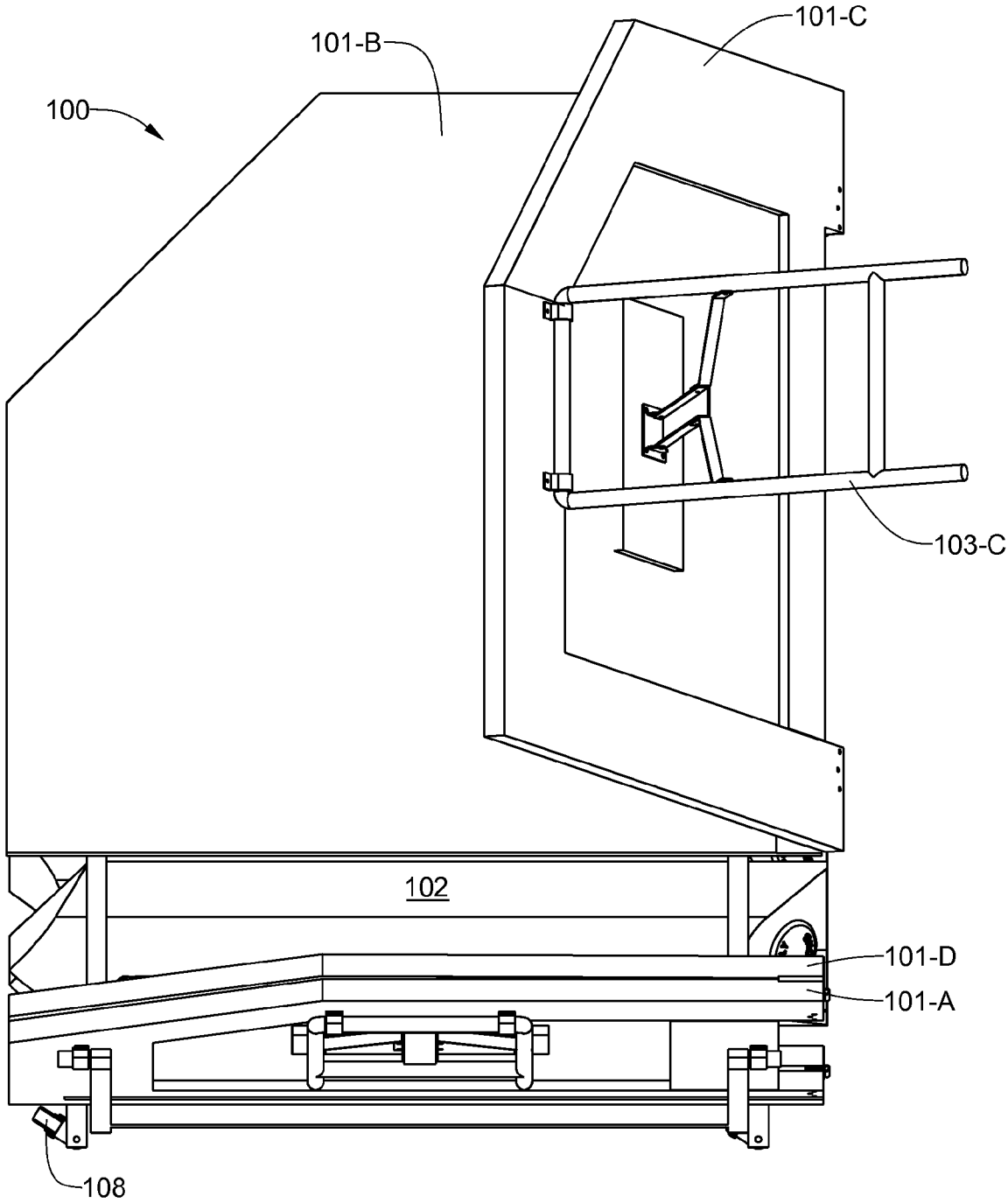
FIG. 7 is a top plan view of the first embodiment new game table in a semi-stowed state.

Referring now to FIG. 7, the partially stowed assembly of FIG. 6 is shown in a top view, with the only difference being that folding leg assembly 103-C is still extended and has not yet been folded so that lies flush against the underside of its associated quarter-section piece.

Figure 8:
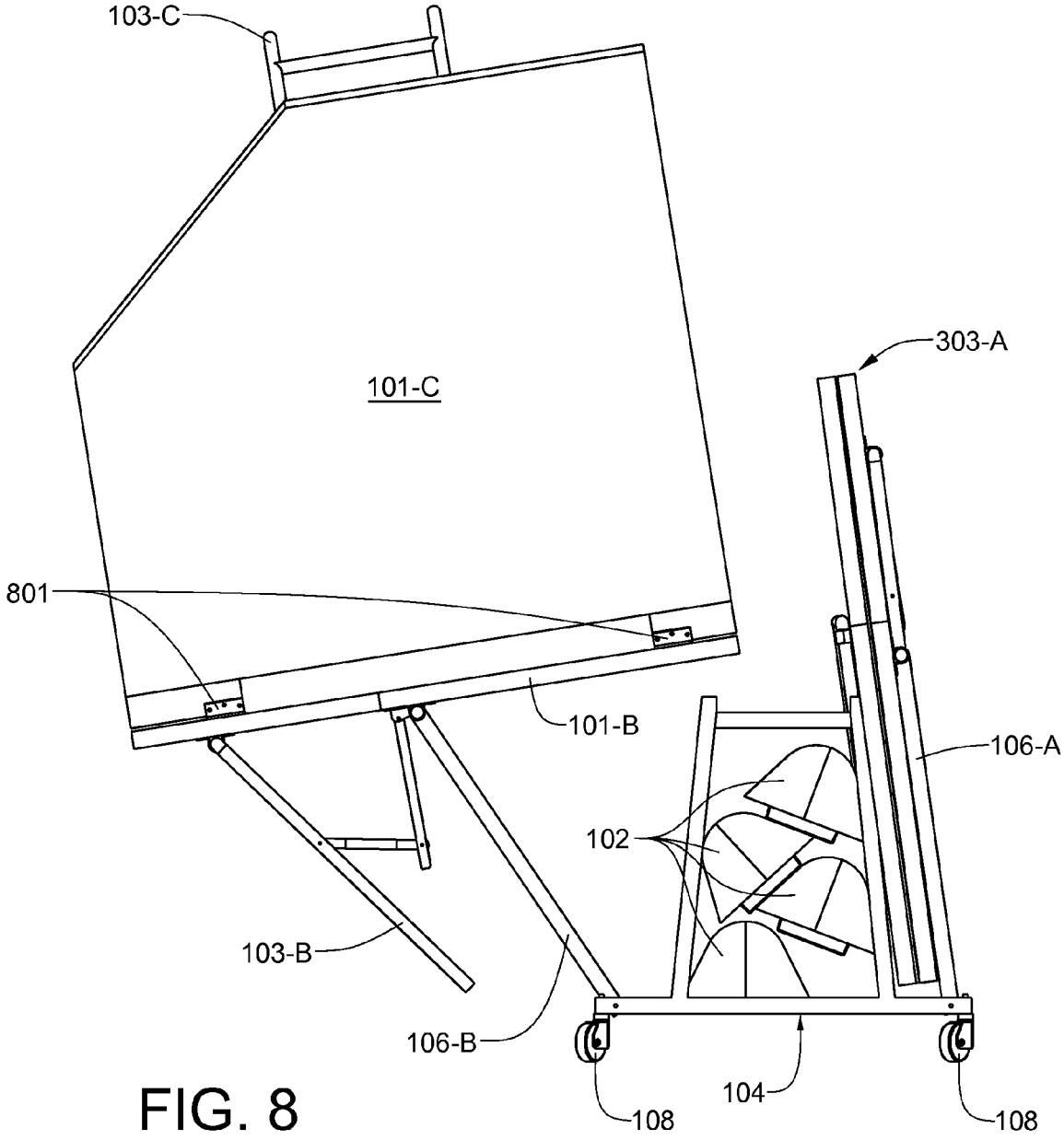
FIG. 8 is an elevational view of the first embodiment new game table in a semi-stowed state, viewed from the outer end of the dolly.

Referring now to FIG. 8, the partially-stowed assembly of FIG. 6 is shown in a side view is an elevational view of the first embodiment new game table in a semi-stowed state, with the differences being that the folding leg assembly 103-C is still extended and the folding leg assembly 103-B is only partially retracted. In this view, the pair of hinges 801, which hingeably intercouple the inner and outer quarter-section pieces 101-B and 101-C of the second quarter-section piece pair 303-B, respectively, are visible.

Figure 9:
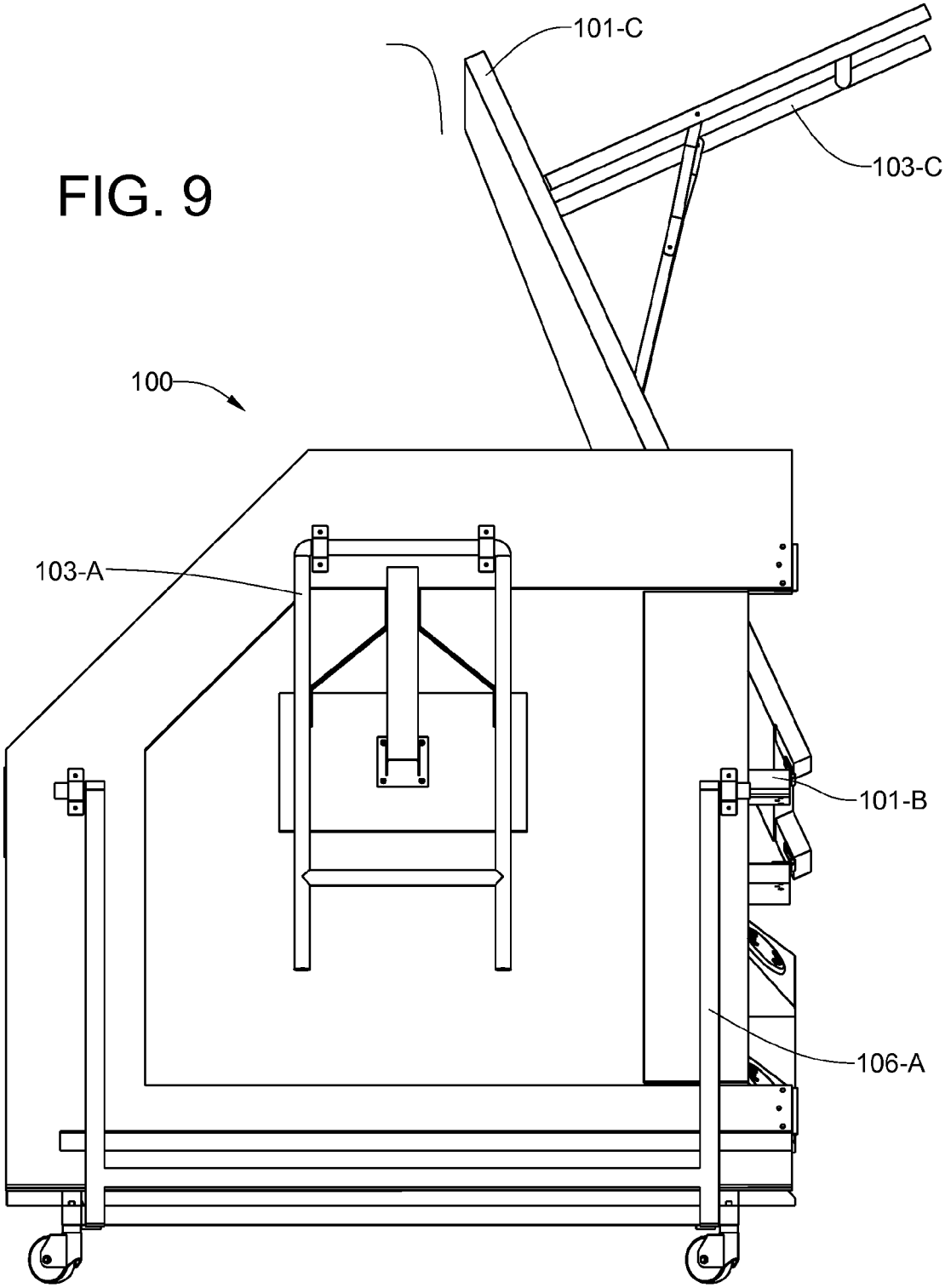
FIG. 9 is a side elevational view of the first embodiment new game table in a semi-stowed state.

Referring now to FIG. 9, this is simply a view of the partially stowed assembly of FIG. 7 from another angle.

Figure 10:
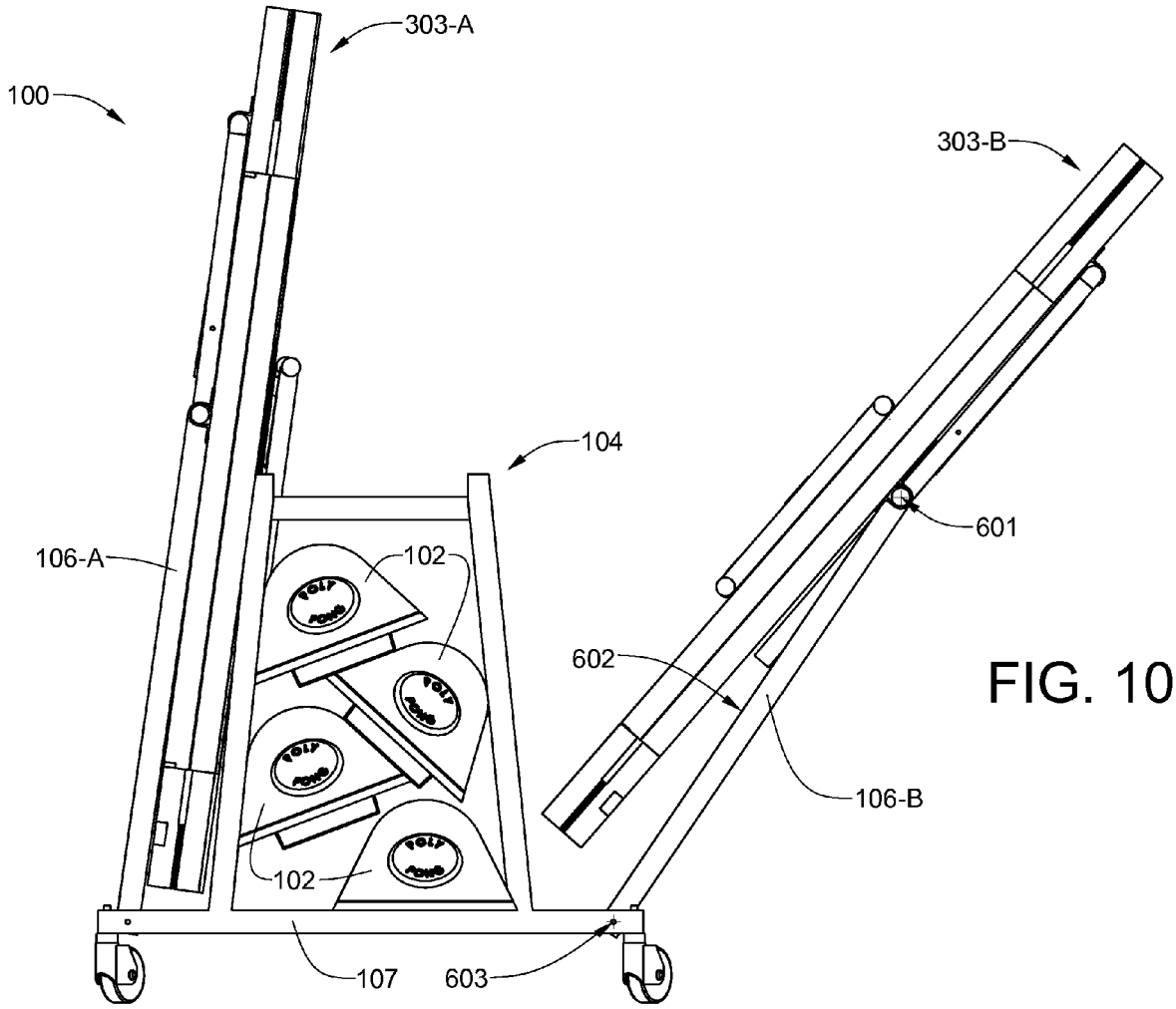
FIG. 10 is an elevational view of the first embodiment new game table in a nearly-stowed state, taken opposite the end where the dolly is installed.

Referring now to FIG. 10, the first embodiment game table 100 is shown in a partially-stowed configuration that is similar to that shown in FIG. 8, except that the view is of the opposite end of the dolly and the outer quarter-section piece 101-C has been folded onto the inner quarter-section piece 101-B, and the folded second quarter-section piece pair 303-B has been rotated about the upper pivot axis 601 of the second support member 106-B to an extent that it is almost touching the dolly-facing side 602 of the second support member 106-A.

Figure 11:
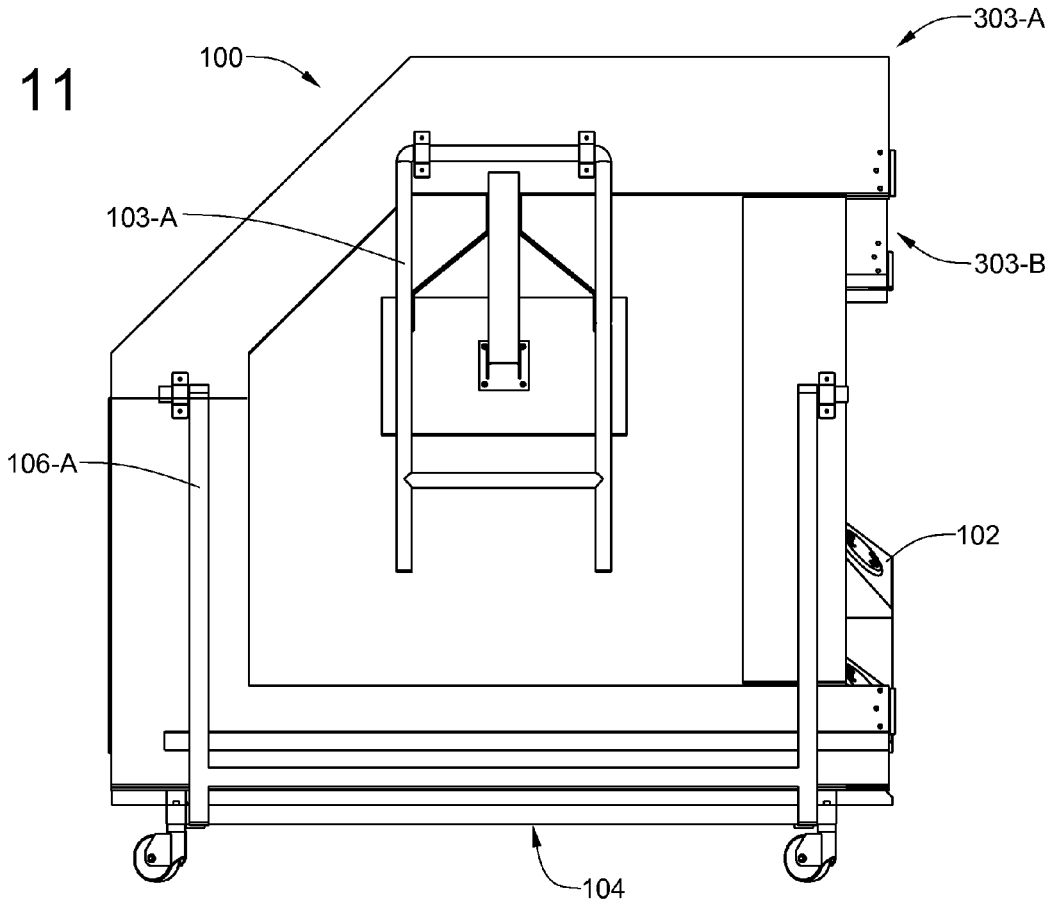
FIG. 11 is a side elevational view of the first embodiment new game table in a nearly-stowed state.

Referring now to FIG. 11, the first embodiment game table 100 is shown in the same partially-stowed configuration as that shown in FIG. 10 but in a view that is orthogonal and from the left in FIG. 10.

Figure 12:
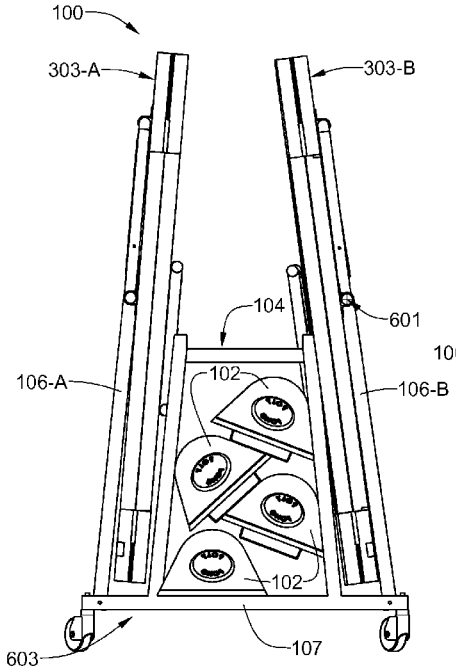
FIG. 12 is an elevational view of the first embodiment new game table in a fully-stowed state, taken opposite the end where the dolly is installed.
Figure 13:
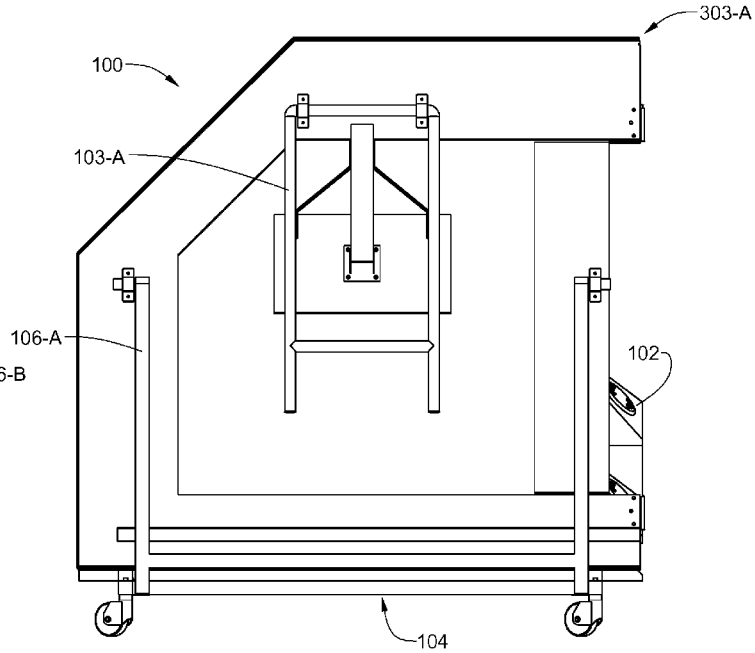
FIG. 13 is a side elevational view of the first embodiment new game table in a fully-stowed state.

Referring now to FIGS. 12 and 13, the first embodiment game table 100 is shown using the same visual projections as those of FIGS. 10 and 11, respectively. However, in FIGS. 12 and 13, the second quarter-section piece pair 303-B is shown fully stowed and leaning against the dolly 104.

Figure 14:
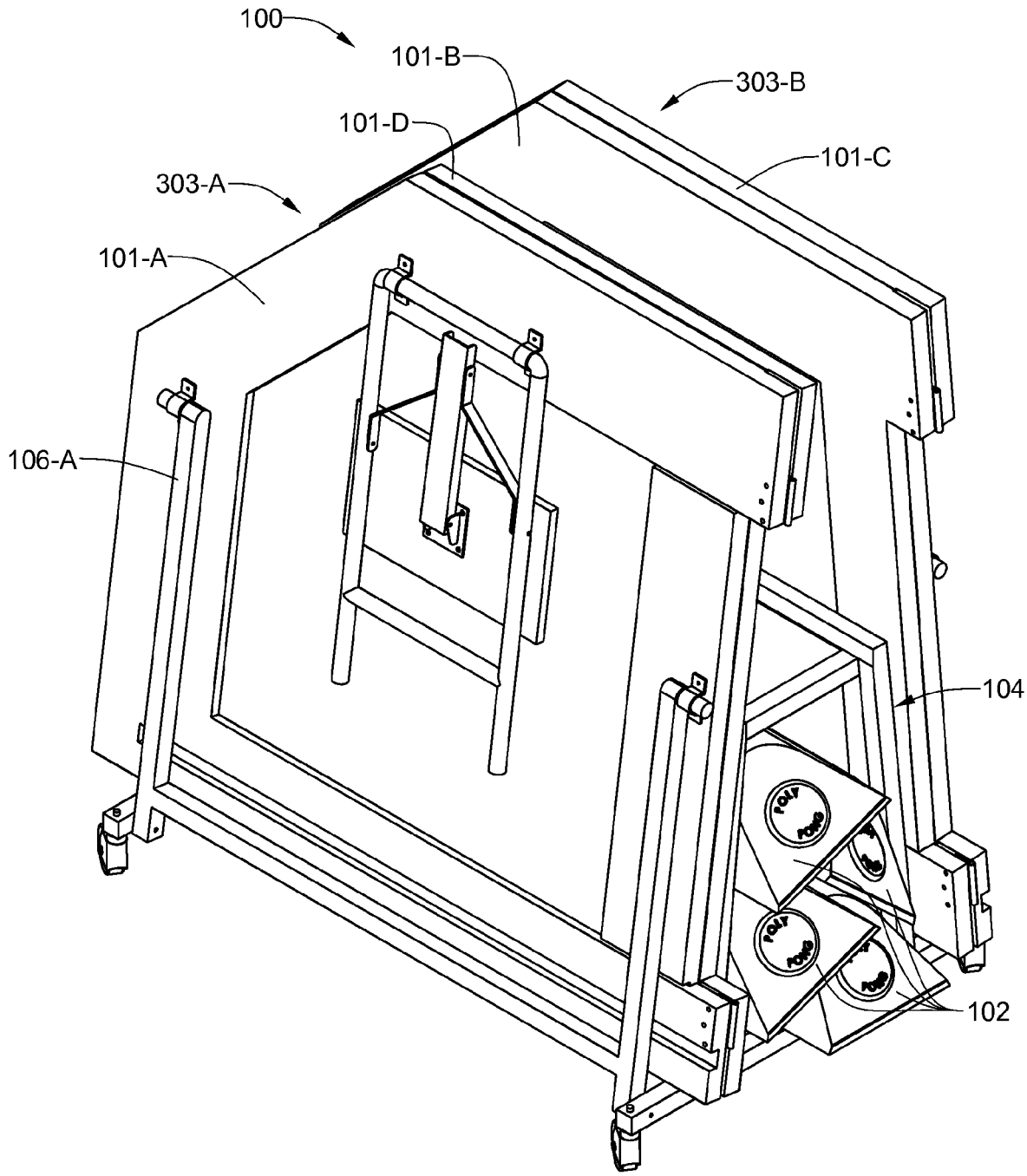
FIG. 14 is an isometric view of the first embodiment new game table in a fully-stowed state, taken opposite the end where the dolly is installed.
Figure 15:
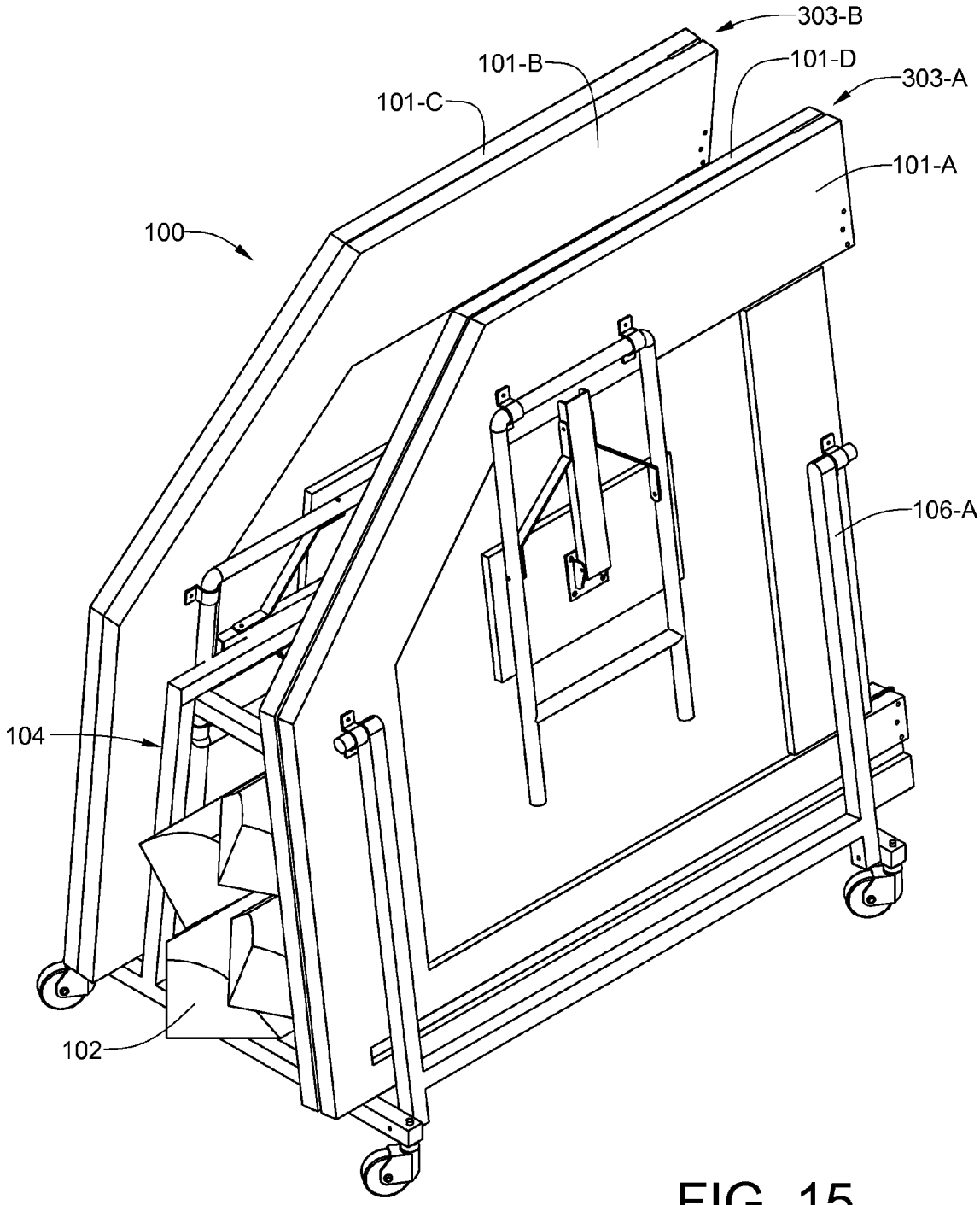
FIG. 15 is an isometric view of the first embodiment new game table in a fully stowed state, taken from the end where the dolly is installed.

Referring now to FIGS. 14 and 15, is an isometric view of the first embodiment new game table in a fully-stowed state, FIG. 14 being taken opposite the end where the dolly is installed, and FIG. 15 being taken from the end where it is installed.

Referring now to FIGS. 16, 17, 18, 19 and 20, a single barrier 1600 for use in combination with the first embodiment new game table 100 is bilaterally symmetrical about a vertical plane 1601 passing through the inner point 1602 and the midpoint 1603 of the lower outer edge 1604. Over a major portion of its length, the barrier 1600 has inwardly sloping sides 1605-A and 1605-B interconnected by a semi-cylindrical surface 1606. The barrier 1600 has a single rectangular downward-facing projection 1606 which locates the barrier 1600 on the surface of the first embodiment game table 100. As four barriers 1600 are used on each first embodiment game table 100, each triangular nose piece 1607 takes up one-fourth of a 360-degree quadrant, allowing all barriers to intersect in the center of the table 100 with no gaps between them in the intersection region.

Figure 21:
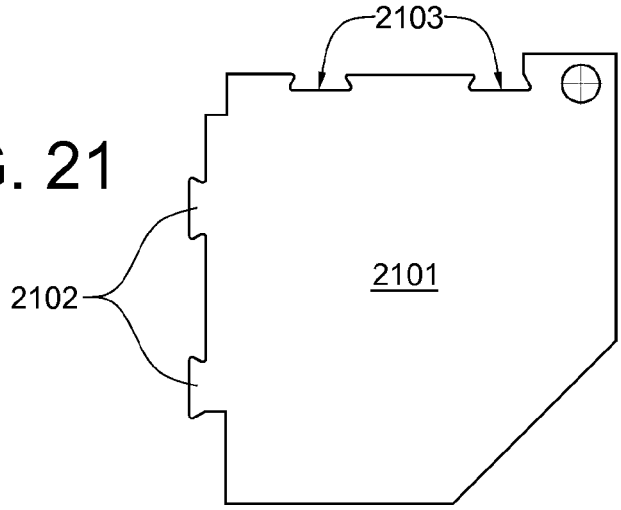
FIG. 21 is top plan view of a quarter-section piece of the table top of a second embodiment new game table.
Figure 22:
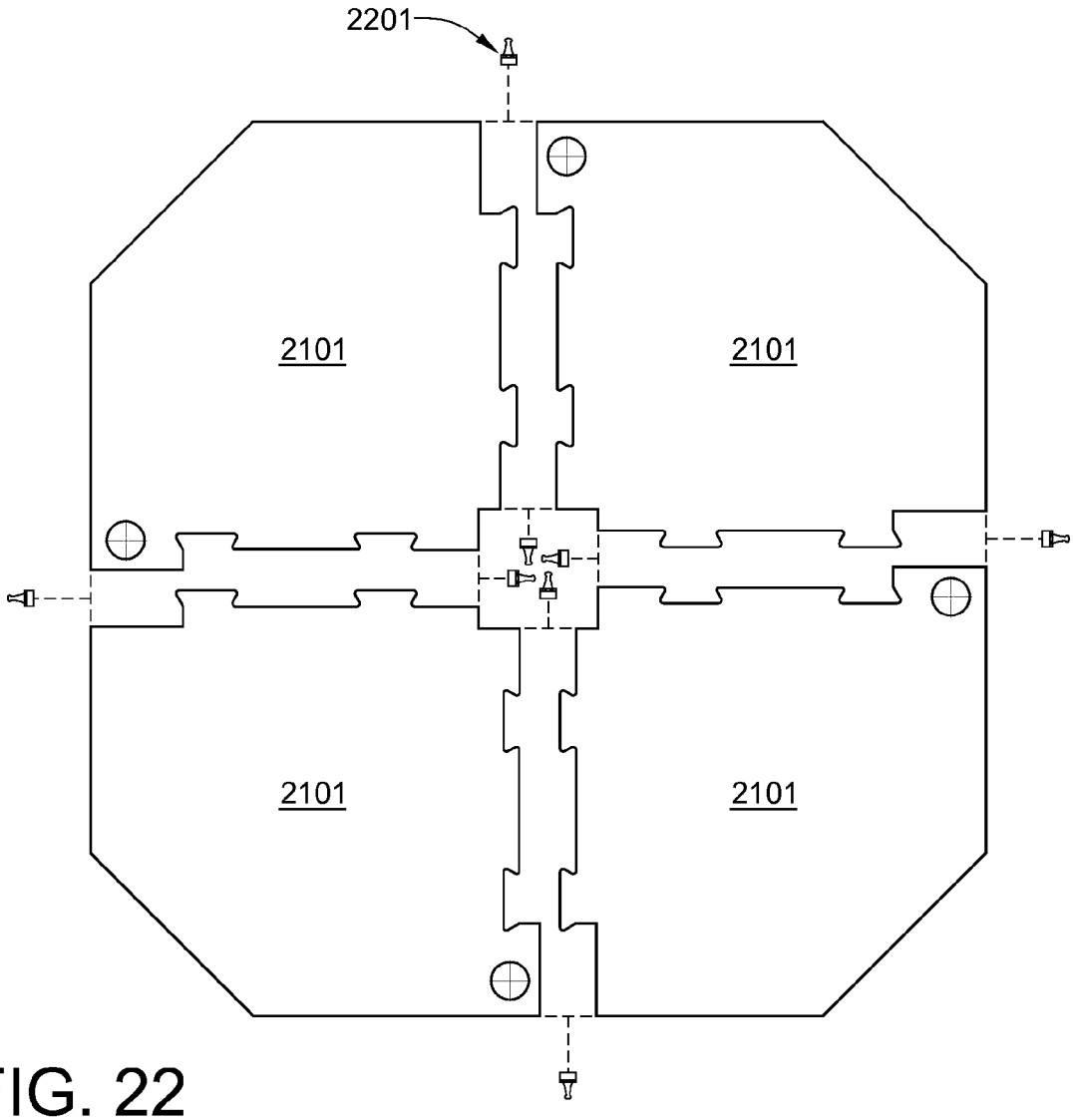
FIG. 22 is an exploded top plan view of the table top of the second embodiment new game table, consisting of four identical quarter-section pieces as shown in FIG. 21.

Referring now to FIGS. 21 and 22, a junior, or smaller, second embodiment of the new game table is made of four identical quarter-section pieces 2101. In FIG. 22, four such pieces 2101 are arranged in an array ready for assembly. It will be noted that each piece 2101 has both tabs 2102 and recesses 2103. The tabs 2102 on one piece are interlockable with the recesses 2103 on an adjacent piece so that they can fit together like pieces of a jigsaw puzzle. Binder clips 2201 will be used to lock the various pieces together as shown in the next drawing figure.

Figure 23:
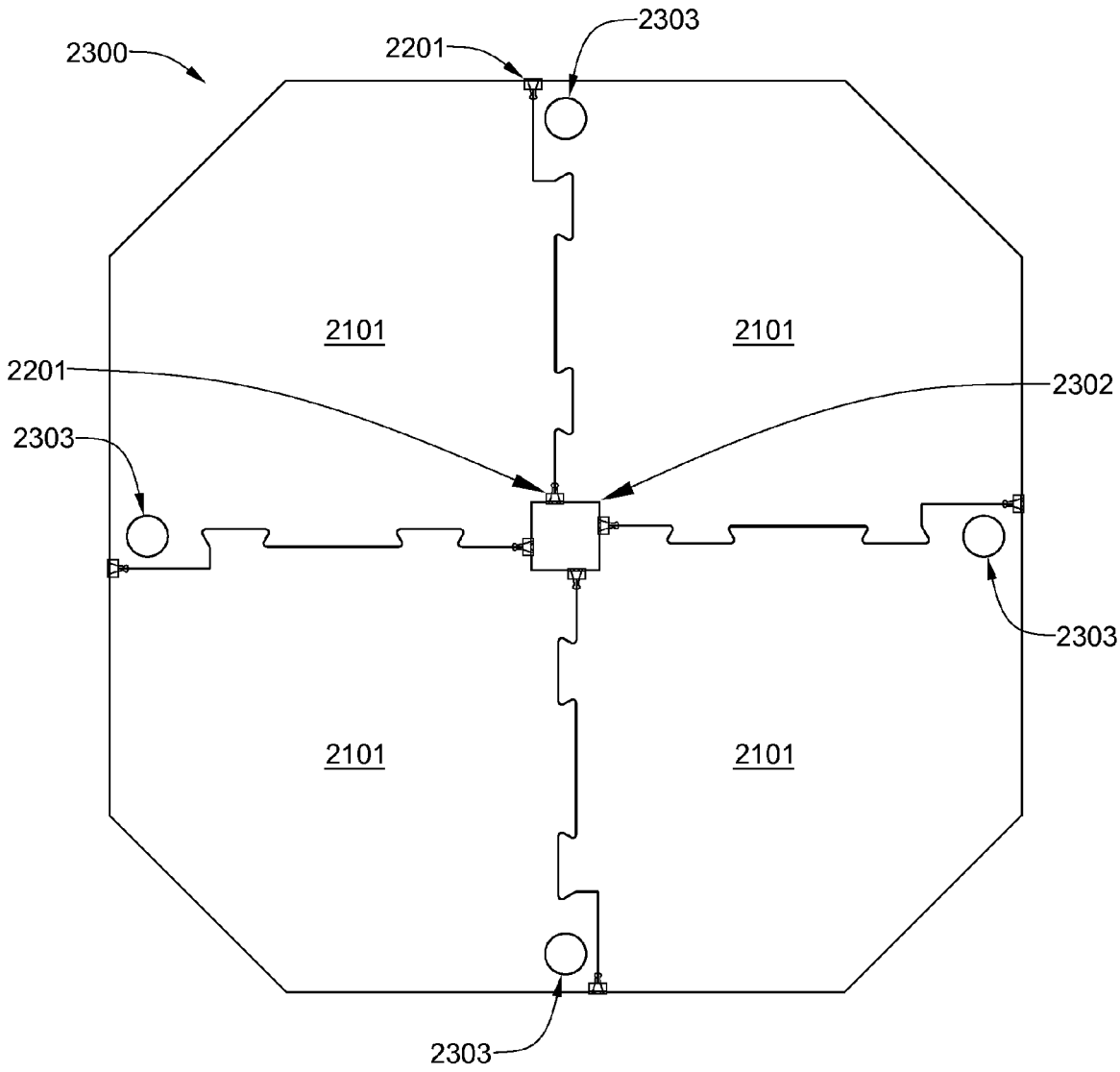
FIG. 23 is a top plan view of an assembled table top of the second embodiment new game table.

Referring now to FIG. 23, the four quarter-section pieces 2101 shown in FIG. 22 have been assembled as a junior second embodiment table assembly 2300. Binder clips 2201 have been used to lock the various pieces together by placing one at the end of each seam 2301 so that it overlaps and squeezes two adjacent pieces. For maximum stability, a binder clip 2201 may be placed at both the inner and outer ends of each seam 2301. It will be noted that there is a square aperture 2302 in the center of the table and four circular apertures 2303 adjacent each seam 2301 near the near the outer edge of the table assembly 2300. Each of the four barriers that will be placed on top of the table assembly 2300 has spaced apart circular and triangular downward projections. The triangular projection takes up one fourth of the area of the square aperture 2302 and the circular projection fills one of the circular apertures 2303.

Figure 24:
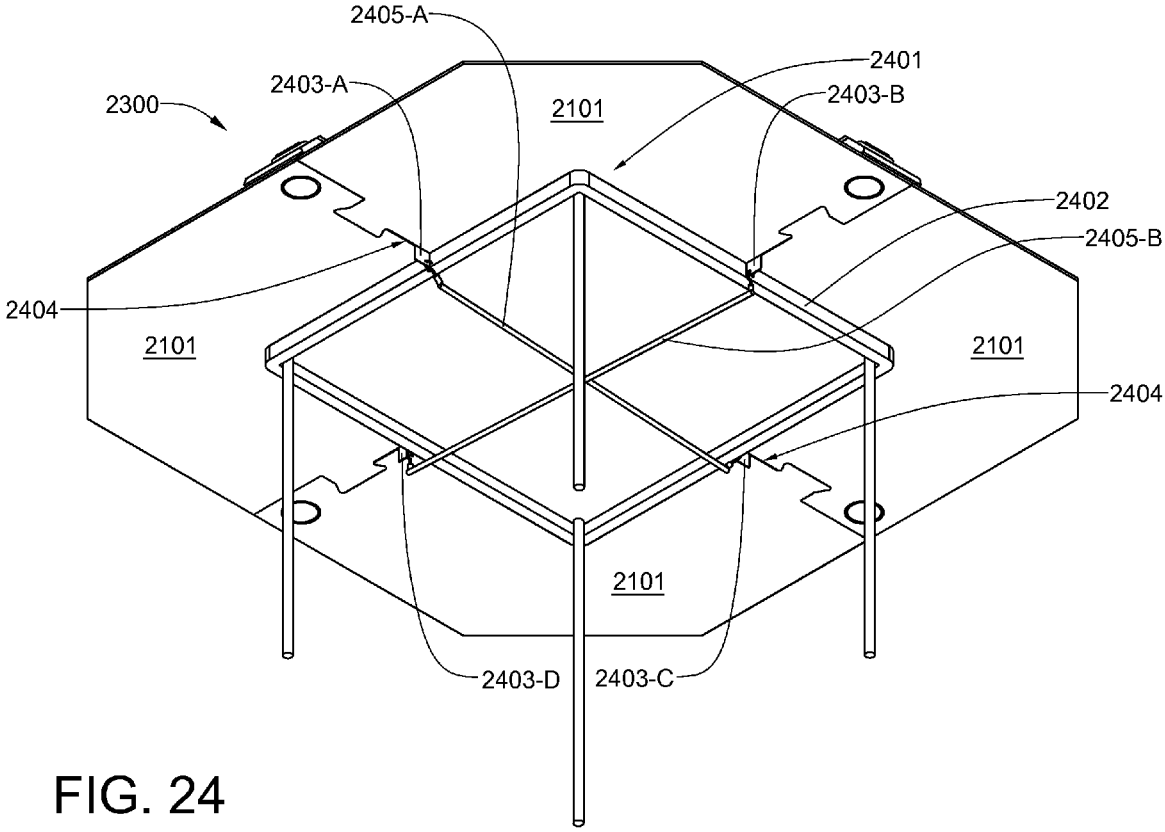
FIG. 24 is an isometric view of an assembled second embodiment new game table, showing primarily, the underside thereof and a conventional card table to which it is strapped.
Figure 25:
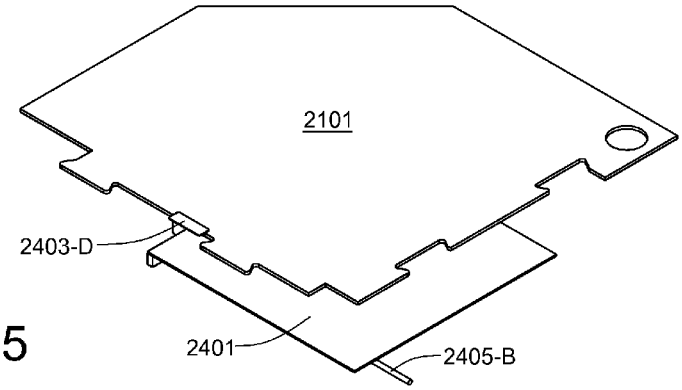
FIG. 25 is an isometric view of a quarter-section piece of the second embodiment new game table suspended over a strap attachment bracket which will be attached thereto.
Figure 26:
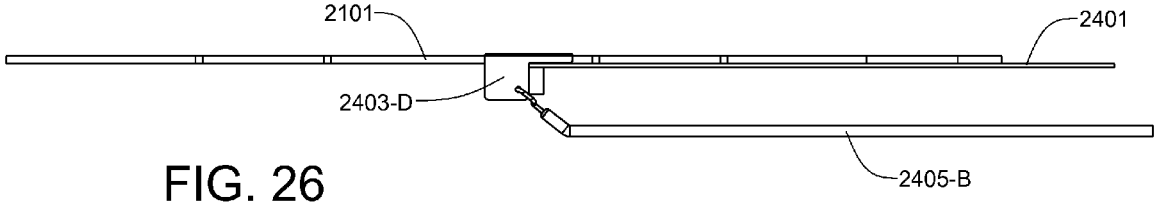
FIG. 26 is a side elevational view of a quarter-section piece of the second embodiment new game table fitted with a strap attachment bracket.
Figure 30:
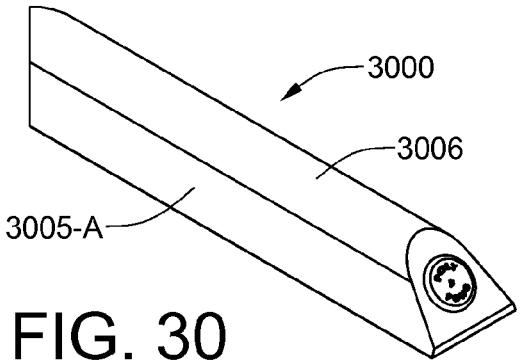
FIG. 30 is an isometric view of a single barrier for use in combination with either the second or third embodiment new game table, showing primarily the upper, side and outer end surfaces.
Figure 31:
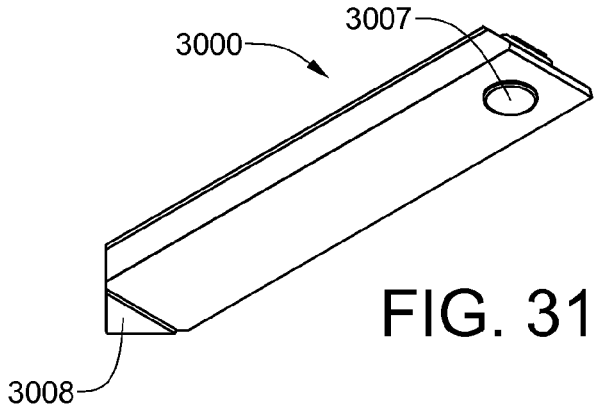
FIG. 31 is an isometric view of the single barrier of FIG. 30, showing primarily the lower and side surfaces thereof.
Figure 32:
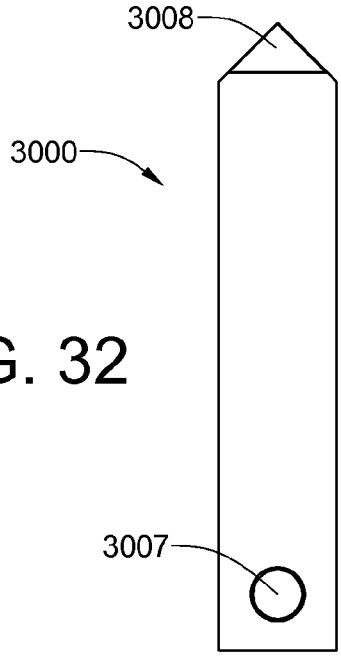
FIG. 32 is a bottom plan view of the single barrier of FIG. 30.
Figure 33:
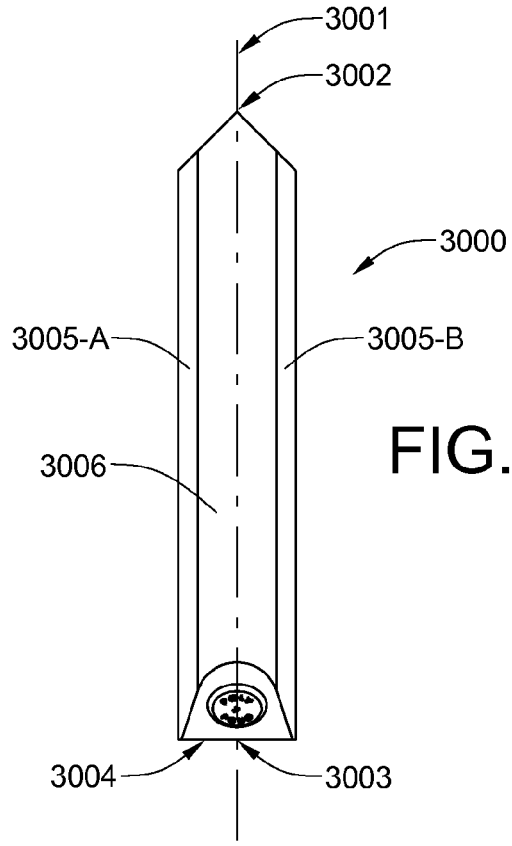
FIG. 33 is a top plan view of the barrier of FIG. 30.
Figure 34:
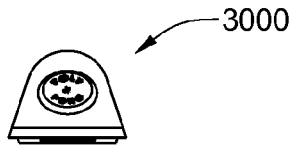
FIG. 34 is a outer end elevational view of the barrier of FIG. 30.

Referring now to FIGS. 24, 25, and 26, the assembled second embodiment table assembly 2300 of FIG. 23 has been placed on a card table 2401 having a square top 2402. Four sheet metal brackets 2403-A, 2403-B, 2403-C and 2403-D are inserted through slots 2404 in the table assembly 2300 which are formed by providing a small gap for several inches along a straight section of the seam 2301. Straps 2405-A and 2405-B are used to interconnect opposed bracket pairs 2403-A/2403-C and 2403-B/2403-D. The straps may be bungee cord straps, straps with hook and look fasteners, or straps of an equivalent type.

Referring now to FIG. 27, an alternative or third embodiment new game table 2700 has a playing surface of the same size and configuration as that of the second embodiment table assembly 2300 of FIGS. 21 to 23. However, instead of being disassembled in four identical quarter-section pieces 2101 for storage and/or transport, the third embodiment new game table 2700 is split in first and second halves 2701-A and 2701-B, which are intercoupled with hinges 2702. It will be noted that the third embodiment game table 2700, like the second embodiment 2300, has a square aperture 2703, but with only a single seam 2704 passing through it, and four circular apertures 2705-A, 2705-B, 2705-C and 2705-D, two of which (2705-B and 2705-D) are centered on the seam 2704 on opposite sides of the table. The square aperture 2703 and the four circular apertures 2705-A, 2705-B, 2705-C and 2705-D will be used to accurately locate the rigid barriers (item 3000 of FIGS. 30-34) on the table top. Slots 2706, which are located on the seam 2704 and slots 2707, which are not located thereon, provide for installation of the sheet metal brackets 2403-A, 2403-B, 2403-C and 2403-D (see FIGS. 24, 25 and 26). Although the junior versions of the new game table 2300 or 2700 have been manufactured using a table top that just fits within a square that is 66 inches or about 1.68 meters on a side, other size table tops may also be used.

Referring now to FIGS. 28 and 29, in order to store or transport the third embodiment table 2700, the first and second halves 2701-A and 2701-B are folded together.

Referring now to FIGS. 30, 31, 32, 33 and 34, a single barrier 3000 for use in combination with either the second or third embodiment new game table (2300 and 2700, respectively) is bilaterally symmetrical about a first vertical plane 3001 passing through the inner point 3002 and the midpoint 3003 of the lower outer edge 3004. Over a major portion of its length, the barrier 3000 has inwardly sloping sides 3005-A and 3005-B interconnected by a semi-cylindrical surface 3006. The barrier 3000 has spaced apart circular and triangular downward projections 3007 and 3008, respectively, which locate the barrier on the surface of the second or third embodiment game table 2300 or 2700. As four barriers 3000 are used on each second or third embodiment game table (2300 and 2700, respectively), the triangular projection 3008 takes up one fourth of the area of the square aperture 2303, and has an internal angle of 90 degrees. The circular projection 3007 fills one of the circular apertures 2404.

Figure 35:
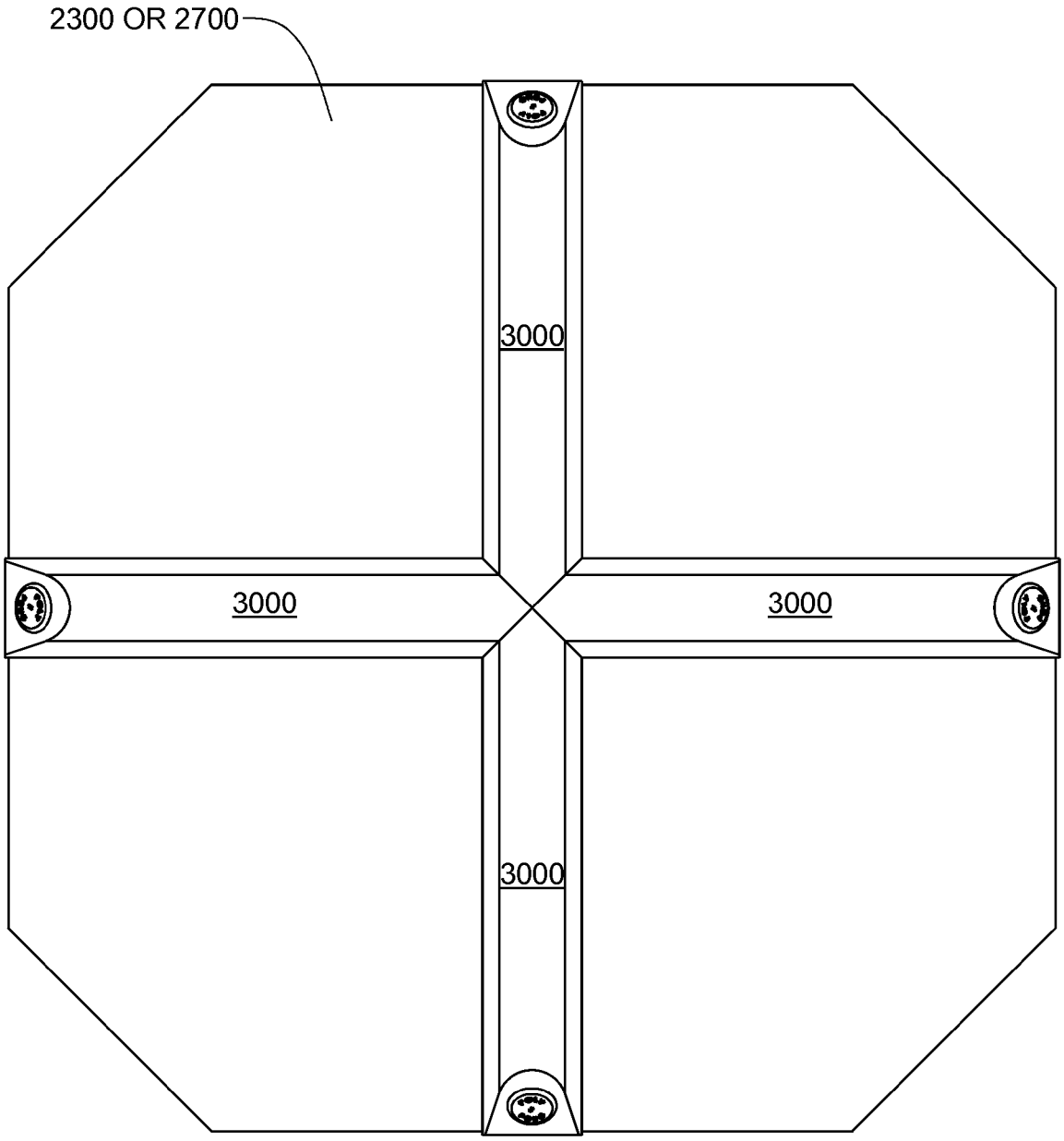
FIG. 35 is a top plan view of an assembled second or third embodiment new game table.
Figure 36:
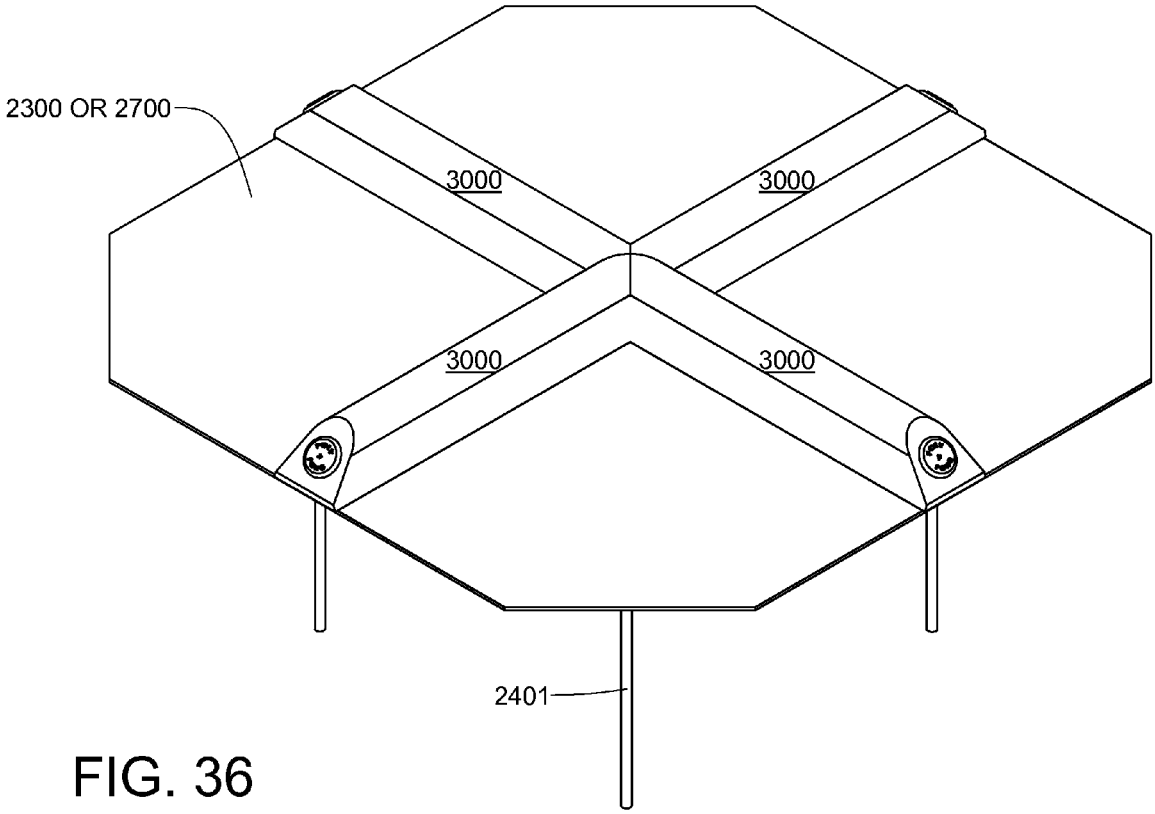
FIG. 36 is an isometric view of an assembled second or third embodiment new game table, showing primarily the top surface and attached barriers thereof.

Referring now to FIGS. 35 and 36, four rigid barriers 3000 of the type shown in FIGS. 30 to 34 have been installed on either the assembled second or third embodiments 2300 or 2700, respectively, of the new game table. As previously explained, each of the four barriers 3000 has spaced apart circular and triangular downward projections 3007 and 3008, respectively. The triangular projection 3008 takes up one fourth of the area of the square aperture 2303 and the circular projection mates with one of the circular apertures 2404, thereby locating each barrier 3000 on the surface of the second or third embodiment game table 2300 and 2700, respectively.

Figure 37:
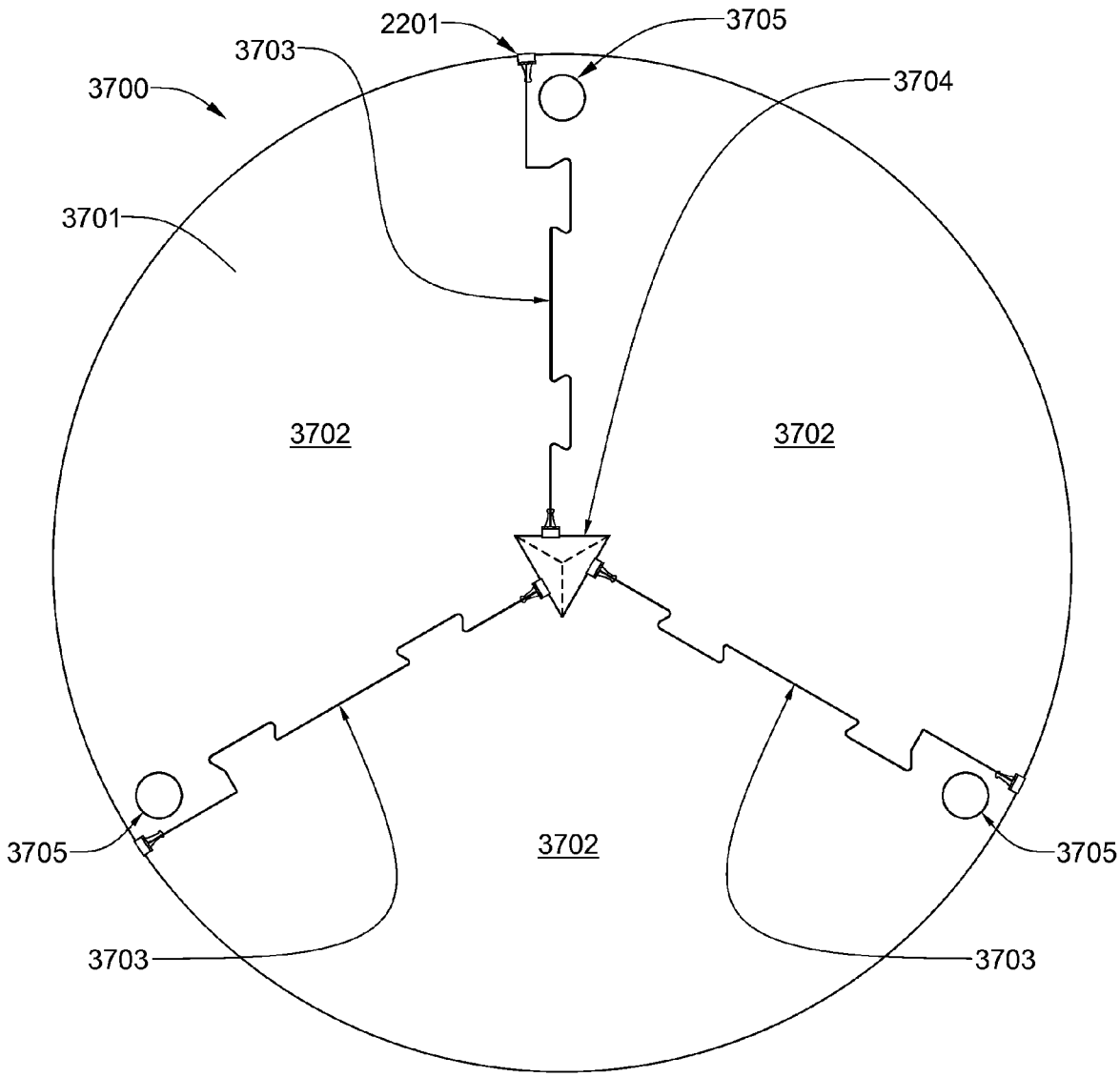
FIG. 37 is a top plan view of a fourth embodiment new game table.
Figure 38:
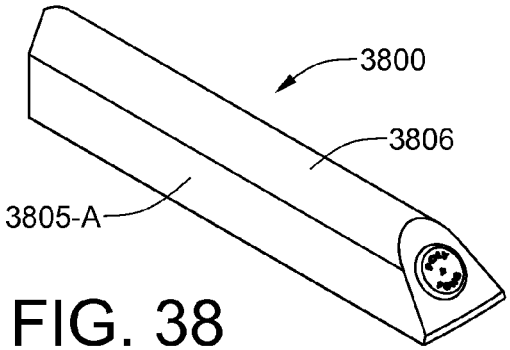
FIG. 38 is an isometric view of a single barrier of the fourth embodiment new game table, showing primarily the upper, side and outer end surfaces.
Figure 39:
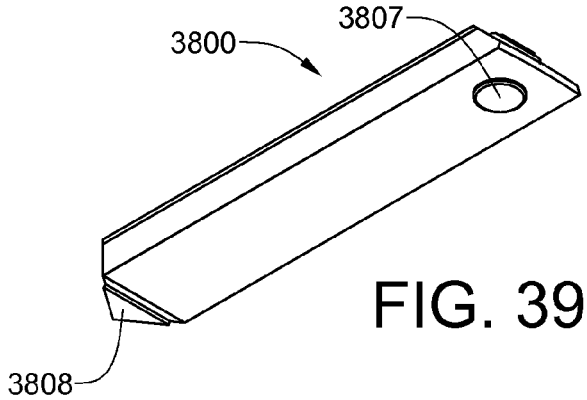
FIG. 39 is an isometric view of the single barrier of FIG. 38, showing primarily the lower and side surfaces thereof.
Figure 40:
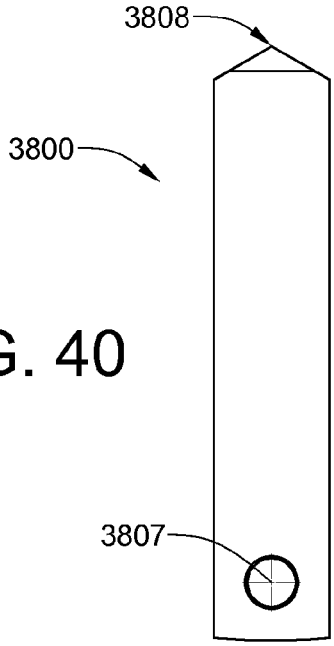
FIG. 40 is a bottom plan view of the single barrier of FIG. 38.
Figure 41:
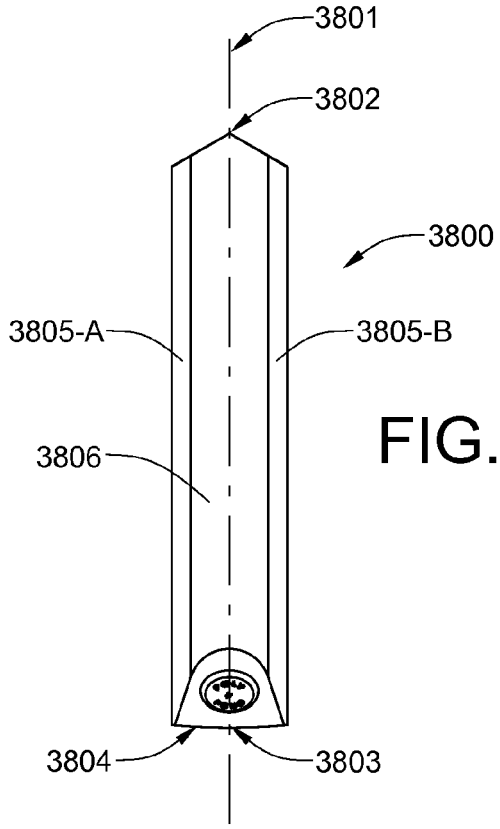
FIG. 41 is a top plan view of the barrier of FIG. 38.
Figure 42:
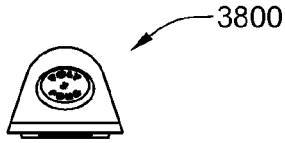
FIG. 42 is an outer end elevational view of the barrier of FIG. 38.

Referring now to FIG. 37, a fourth embodiment new game table 3700 has a circular playing surface 3701 made of three identical interlocking third-section pieces 3702. As with the second embodiment 2300, binder clips 2301 may be used to lock the three third-section pieces 3702 together by placing a binder clip 2301 at the end of each seam 3703 so that it overlaps and squeezes two adjacent pieces. For maximum stability, a binder clip may be placed at both the inner and outer ends of each seam 3703. It will be noted that there is a triangular aperture 3704 in the center of the table and three circular apertures 3705 adjacent each seam 3706 near the near the outer edge of the table assembly 3700. Each of the three barriers that will be placed on top of the table top assembly 3700 has spaced apart circular and triangular downward projections and will cover a single seam 3703. The triangular projection takes up one third of the area of the triangular aperture 3704 and the circular projection fills one of the circular apertures 3705. The fourth embodiment game table may have a diameter ranging from about 60 inches, or about 1.5 meters, to about 108 inches, or about 2.75 meters. It would be difficult for an average person to retrieve an out-of-play ball that is stationary near the center intersection of the barriers if the diameter were much larger than that 2.75 meters.

Referring now to FIGS. 38, 39, 40, 41, and 42, a single barrier 3800 for use in combination with the fourth embodiment new game table 3700 is, like the other barriers previous shown and described, bilaterally symmetrical about a vertical plane 3801 passing through the inner point 3802 of the barrier and the midpoint 3803 of the lower outer edge 3804. Over a major portion of its length, the barrier 3800 has inwardly sloping sides 3805-A and 3805-B interconnected by a semi-cylindrical surface 3006. The barrier 3800 has spaced apart circular and triangular downward projections 3807 and 3008, respectively, which locate the barrier 3800 on the surface of the fourth embodiment game table 3700. As three barriers 3800 are used on each fourth embodiment game table 3700, the triangular projection 3008 takes up one third of the area of the triangular aperture 3704, and has an internal angle of 120 degrees. The circular projection 3007 fills one of the circular apertures 3705.

Figure 43:
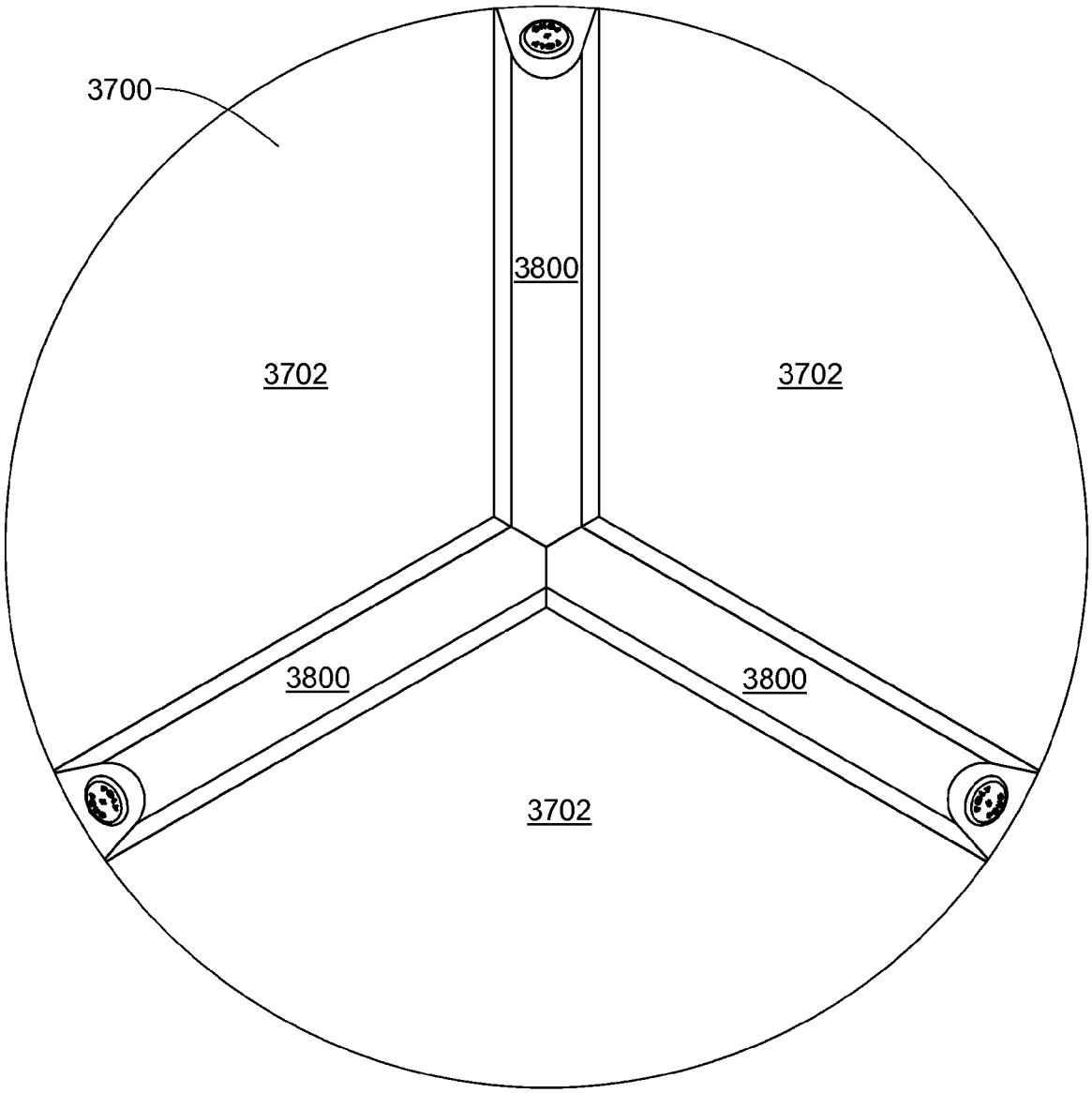
FIG. 43 is a top plan view of an assembled fourth embodiment new game table.

Referring now to FIG. 43, three barriers 3800 have been placed on the fourth embodiment game table 3700. It will be noted that all three barriers 3800 intersect at a point 4301 in the center of the table 3700 and are all equiangularly spaced from one another.

Figure 44:
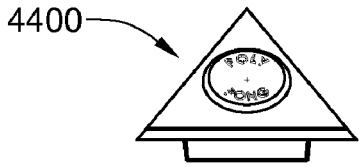
FIG. 44 is an outer end elevational view of a barrier having an equilateral triangular cross section.
Figure 45:
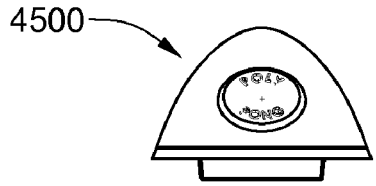
FIG. 45 is an outer end elevational view of a barrier having a parabolic cross section.
Figure 46:
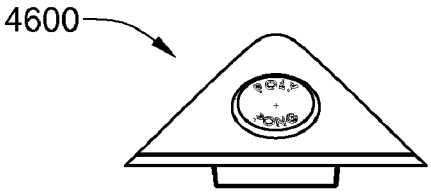
FIG. 46 is an outer end elevational view of a barrier having a half-hyperbolic cross section.
Figure 47:
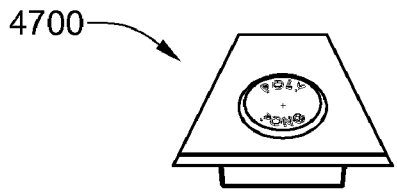
FIG. 47 is an outer end elevational view of a barrier having an equilateral trapezoidal cross section.
Figure 48:
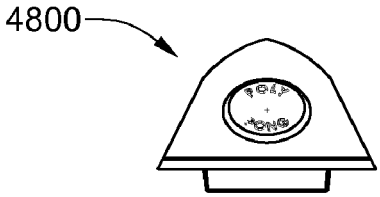
FIG. 48 is an outer end elevational view of a barrier having an equilateral cross section that is uniformly sloped on the sides thereof and curved to an apex in the center.
Figure 49:
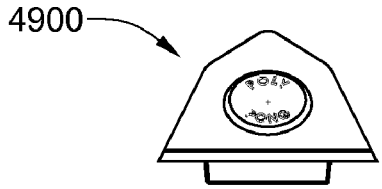
FIG. 49 is an outer end elevational view of a barrier having a cross section that is an equilateral, inwardly-sloping polygon.

Referring now to FIGS. 44 to 49 different shapes of rigid barriers are shown which can be used on the first embodiment game table 100 of FIG. 1. However, these shapes can also be applied to the rigid barriers used on the second, third and fourth embodiments of the new game table. FIG. 44 shows a rigid barrier 4400 having an equilateral triangular cross section; FIG. 45 shows a rigid barrier 4500 having a parabolic cross section; FIG. 46 shows a rigid barrier 4600 having a half-hyperbolic cross section; FIG. 47 shows a rigid barrier 4700 having an equilateral trapezoidal cross section; FIG. 48 shows a rigid barrier 4800 having an equilateral cross section that is uniformly sloped on the sides thereof and curved to an apex in the center; and FIG. 49 shows a rigid barrier 4900 having a cross section that is an equilateral, inwardly-sloping polygon.

Although only several embodiments of the new game table and associated rigid barriers have been heretofore described, it will be obvious to those having ordinary skill in the art that changes and modifications may be made thereto without departing from the scope and the spirit of the invention as hereinafter claimed.

What is claimed is:

1. A game apparatus for use with a projectile and comprising:

a playing surface having at least two and no more than three lines of symmetry about which said playing surface is bilaterally symmetrical, said lines of symmetry having a point of intersection; and a plurality of generally identical, intersecting, equiangularly-spaced, rigid barriers positioned atop said playing surface and radiating from said point of intersection to an outer edge of said playing surface, each barrier having a continuous, unbroken exposed surface, said rigid barriers dividing said playing surface into at least three and no more than four independent playing stations.

2. The game apparatus of claim 1, wherein each of said rigid barriers is bilaterally symmetrical about a vertical plane passing longitudinally therethrough.

3. The game apparatus of claim 2, wherein an upper outer surface portion of each of said rigid barriers is a generally semicylindrical.

4. The game apparatus of claim 2, wherein a cross section through a major portion of each rigid barrier, taken perpendicular to said vertical plane, is a conical section.

5. The game apparatus of claim 1 wherein, for a four independent playing station embodiment, said playing surface is divided into four individual quarter-section pieces, each quarter-section piece corresponding to an individual playing station, and wherein a first pair of quarter-section pieces on one side of a line of bilateral symmetry is not directly coupled to a second pair of quarter-section pieces on the other side, the quarter-section pieces of each pair being hingeably coupled together such that an outer quarter-section piece of each pair folds on top of an inner quarter-section piece of that pair, and wherein the inner quarter-section pieces of both pairs are adjacent one another, said game apparatus further comprising:

a folding leg assembly attached to each quarter-section piece, said folding leg assembly being movable between extended and retracted positions, said folding leg assembly supporting the quarter-section piece to which it is attached when it is in the extended position when said apparatus is set up for use in a playing configuration, said folding leg assembly rotating to a retracted position against an underside of said quarter section piece when said apparatus is folded up for storage or transport;

a dolly positioned beneath said surface between both inner quarter-section pieces;

a first support member hingeably coupled to both a bottom portion of a first side of said dolly and to a bottom surface of the inner quarter-section piece of said first pair; and a second support member hingeably coupled to both a bottom portion of a second side of said dolly and to a bottom surface of the inner quarter-section piece of said second pair; and wherein each pair of quarter-section pieces is rotatable to a near-vertical position so that it can be stored on one side of said dolly.

6. The game apparatus of claim 5, wherein said dolly further comprises a pair of horizontal parallel rails on a top portion thereof, and each inner quarter-section piece has a groove which fits over one of said parallel rails, thereby providing alignment and support of said first and second quarter-section pairs when said apparatus is set up for use in a playing configuration.

7. The game apparatus of claim 1, wherein each of the rigid barriers has at least one projection on a bottom surface thereof which mates with at least one corresponding aperture in said playing surface, said at least one aperture being positioned between a pair of independent playing stations.

8. The game apparatus of claim 1, wherein all rigid barriers are substantially identically shaped, with each having an intersecting end pointed, said pointed end having an interior angle equal in degrees to 360 divided by the number of independent playing stations, such that all rigid barriers fit together with no significant gaps between the pointed intersecting ends, the points of which meet at said point of intersection.

9. The game apparatus of claim 1, wherein said playing surface has a plurality of brackets extending beneath a lower supporting surface thereof, said brackets enabling said playing surface to be strapped to a top of a foldable card table.

10. The game apparatus of claim 1, wherein said playing surface comprises at least three and no more than four separate pieces, each corresponding generally to an independent playing station and shaped to as to fit together, in regions beneath the rigid barriers, like pieces of a jigsaw puzzle.

11. A game table for playing variations of table tennis using paddles and at least one table tennis ball, said table comprising:

a table top having a playing surface; and a plurality of generally identical, intersecting, equiangularly-spaced, rigid barriers positioned atop said playing surface and radiating from a center point of said playing surface, each barrier having a continuous, unbroken exposed surface, said rigid barriers dividing said playing surface into at least three and no more than four independent playing stations, all of which are of identical size and shape.

12. The game table of claim 11, wherein each of said rigid barriers is bilaterally symmetrical about a vertical plane passing longitudinally therethrough.

13. The game table of claim 12, wherein an upper outer surface portion of each of said rigid barriers is a generally semicylindrical.

14. The game table of claim 12, wherein a cross section through a major portion of each rigid barrier, taken perpendicular to said vertical plane, is a conical section.

15. The game table of claim 12, wherein an outer surface of each rigid barrier comprises a pair of upwardly sloping planar surfaces interconnected by a semicylindrical surface.

16. The game table of claim 11 wherein, for a four independent playing station embodiment, said table top is divided into four individual quarter-section pieces, each quarter-section piece corresponding to an individual playing station, and wherein a first pair of quarter-section pieces on one side of a playing surface line of bilateral symmetry is not directly coupled to a second pair of quarter-section pieces on the other side, the quarter-section pieces of each pair being hingeably coupled together such that an outer quarter-section piece of each pair folds on top of an inner quarter-section piece of that pair, and wherein the inner quarter-section pieces of both pairs are adjacent one another, said game apparatus further comprising:

a folding leg assembly attached to each quarter-section piece, said folding leg assembly being movable between extended and retracted positions, said folding leg assembly supporting the quarter-section piece to which it is attached when it is in the extended position when said game table is set up for use in a playing configuration, said folding leg assembly rotating to a retracted position against an underside of said quarter section piece when said game table is folded up for storage or transport;

a dolly positioned beneath said surface between both inner quarter-section pieces;

a first support member hingeably coupled to both a bottom portion of a first side of said dolly and to a bottom surface of the inner quarter-section piece of said first pair; and a second support member hingeably coupled to both a bottom portion of a second side of said dolly and to a bottom surface of the inner quarter-section piece of said second pair; and wherein each pair of quarter-section pieces is rotatable to a near-vertical position so that it can be stored on one side of said dolly.

17. The game table of claim 16, wherein said dolly further comprises a pair of horizontal parallel rails on a top portion thereof, and each inner quarter-section piece has a groove which fits over one of said parallel rails, thereby providing alignment of said first and second quarter-section pairs.

18. The game table of claim 11, wherein each of the rigid barriers has at least one projection on a bottom surface thereof which mates with at least one corresponding aperture in said playing surface, said at least one aperture being positioned between a pair of independent playing stations.

19. The game table of claim 11, wherein said table top comprises at least three and no more than four separate pieces, each corresponding generally to an independent playing station and shaped to as to fit together, in regions beneath the rigid barriers, like pieces of a jigsaw puzzle.

20. The game table of claim 11, wherein for a four independent playing station embodiment, said table top is divided into identical hingeably intercoupled halves, each half corresponding to two independent playing stations, such that said halves can be folded together for storage.

* * * * *